US005629763A

United States Patent [19]

Isobe et al.

[11] Patent Number: 5,629,763

[45] Date of Patent: May 13, 1997

[54] ORIGINAL TRANSPORTING DEVICE CAPABLE OF EFFECTING EXPOSURE WHILE TRANSPORTING THE ORIGINAL

[75] Inventors: Yoshinori Isobe, Tokyo; Chikara Sato, Hachioji; Akimaro Yoshida, Yokohama, all of Japan

[73] Assignee: Canon Kabushiki Kaisha, Tokyo, Japan

[21] Appl. No.: 318,386

[22] Filed: Oct. 5, 1994

[30] Foreign Application Priority Data

Oct. 8, 1993 [JP] Japan ..... 5-252718

[51] Int. Cl.[6] ..... G03G 21/00

[52] U.S. Cl. ..... 399/371; 271/3.13

[58] Field of Search ..... 355/75, 308, 309, 355/320, 321; 271/3, 3.1, 4, 6, 7, 3.13

[56] References Cited

U.S. PATENT DOCUMENTS

| | | | |
|---|---|---|---|
| 4,523,837 | 6/1985 | Temple et al. | 355/51 |
| 4,548,404 | 10/1985 | Brandt et al. | 271/303 |
| 4,684,237 | 8/1987 | Buchar et al. | 355/8 |
| 4,860,057 | 8/1989 | Saeki et al. | 355/23 |
| 5,132,741 | 7/1992 | Kitajima et al. | 355/309 |
| 5,351,112 | 9/1994 | Naito et al. | 355/233 |
| 5,371,580 | 12/1994 | Kato et al. | 355/320 |

OTHER PUBLICATIONS

European Search Report.

*Primary Examiner*—William J. Royer

*Attorney, Agent, or Firm*—Fitzpatrick, Cella, Harper & Scinto

[57] ABSTRACT

An original transporting device for transporting an original to an exposure unit of a copying machine which includes a loading tray for loading the originals, a first separation unit, a first transporting unit, a second separation unit, a second transporting unit, a third transporting unit for transporting the original transported by the first transporting unit in a first direction, stopping it at the exposure unit, then transporting it in a second direction and transporting the original transported by the second transporting unit in the second direction to pass through the exposure unit. Finally, an ejection system is included for ejecting the original transported by the third transporting unit from the exposure unit in the second direction on to the loading tray, where the transporting speed of the second transporting unit is higher than the transporting speed of the third transporting unit in the second direction, where the original interval between the previous original and the current original can be rendered closer to accord the maximum ability of the copying machine so that the maximum productivity can be attained.

12 Claims, 31 Drawing Sheets

| FIG. 14A | FIG. 14B |
|---|---|

ORIGINAL TRANSPORTING DEVICE CAPABLE OF EFFECTING EXPOSURE WHILE TRANSPORTING THE ORIGINAL

BACKGROUND OF THE INVENTION

1. Field of the Invention

The present invention relates to an original transporting device capable of effecting exposure while transporting the original.

2. Related Background Art

FIG. 33 is a cross-sectional view showing an example of a sheet transporting device.

In the figure, 1001 is a sheet transporting device main body, disposed at a predetermined position on the top portion of an image processing apparatus. 1002 is a platen glass, 1003 is a transporting belt for transporting the original in an E or D direction by driving a transporting roller 1007. 1004 is an original tray on which the original bundle P is laid. 1005 is a half-moon shaped feeding roller for separating an original on the bottom of the original bundle P laid on the original tray 1004 and delivering it into a transporting passageway.

1006 is an original feeding belt for transporting the original sheet (sheet member), in corporation with the feeding roller 1008, delivered from the original tray 1004 via the transporting passageway toward a direction where the platen glass 1002 is arranged. 1009 is an original exposure portion, scanned at a predetermined speed in an A direction, for leading a reflected image of the original laid on the platen glass 1002 into an imaging system (not shown). 1010 is a large transporting roller which rotates in a forward or reverse direction to turn over the original, or eject the original. 1011 is a paper ejection roller which serves to load the original which has been read on to the original tray 1004 again.

In a device thus constructed, the sheet member from the original tray 1004 is transported from the B end side of the platen glass 1002 into an image reading position, where the sheet is placed in an arbitrary disposition, after which the original exposure portion 1009 of the sheet transporting device main body 1001 is moved in the A direction to read the original, and after completion of reading, the sheet member is ejected from the B end side of the platen glass 1002 and loaded again onto the original tray 1004.

In contrast to an original fixed reading mode, another reading mode referred to as an original flow reading mode has been proposed in which, with the original exposure portion 1009 of the image forming device fixed, the sheet member is transported from the C end side into the other end in the figure to read the original, in order to effect fast image formation without high speed transportation.

However, in the original flow reading mode, there was a problem that in reading the original image, if the time interval to feed the copying paper successively in the main body is sufficient to have the time interval to feed the original successively, the performance of the main body can be completely drawn out, but due to the difference in the kind of the original or the loading amount of originals, or the difference in the environmental conditions, separation of the original from the original tray may be delayed, so that the time interval permissible to feed the original is extended beyond the time interval to feed the copying paper successively in the main body, resulting in a decrease in productivity.

SUMMARY OF THE INVENTION

An object of the present invention is to provide an original transporting device for which the aforementioned problem has been resolved.

Also, it is another object of the present invention to provide an original transporting device which can transport the original in closer interval between originals, when effecting exposure while transporting the original.

It is a further object of the present invention to provide an original transporting device which can provide high productivity.

Other objects and features of the present invention will be apparent from the following description and the annexed drawings.

DETAILED DESCRIPTION OF THE PREFERRED EMBODIMENTS

Figure 1:
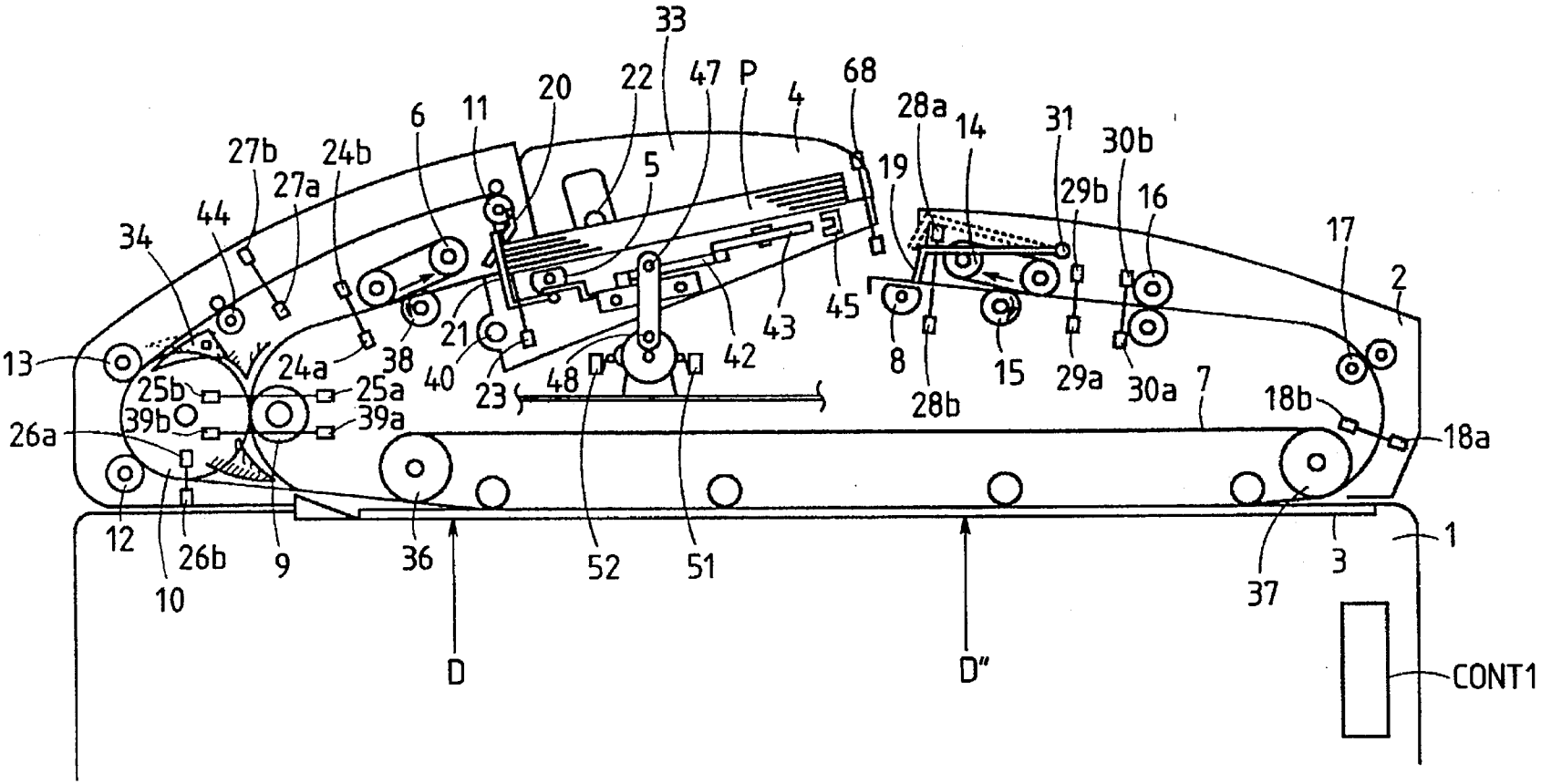
FIG. 1 is a cross-sectional view for explaining the essential constitution of a sheet transporting device according to an embodiment of the present invention.
Figure 2:
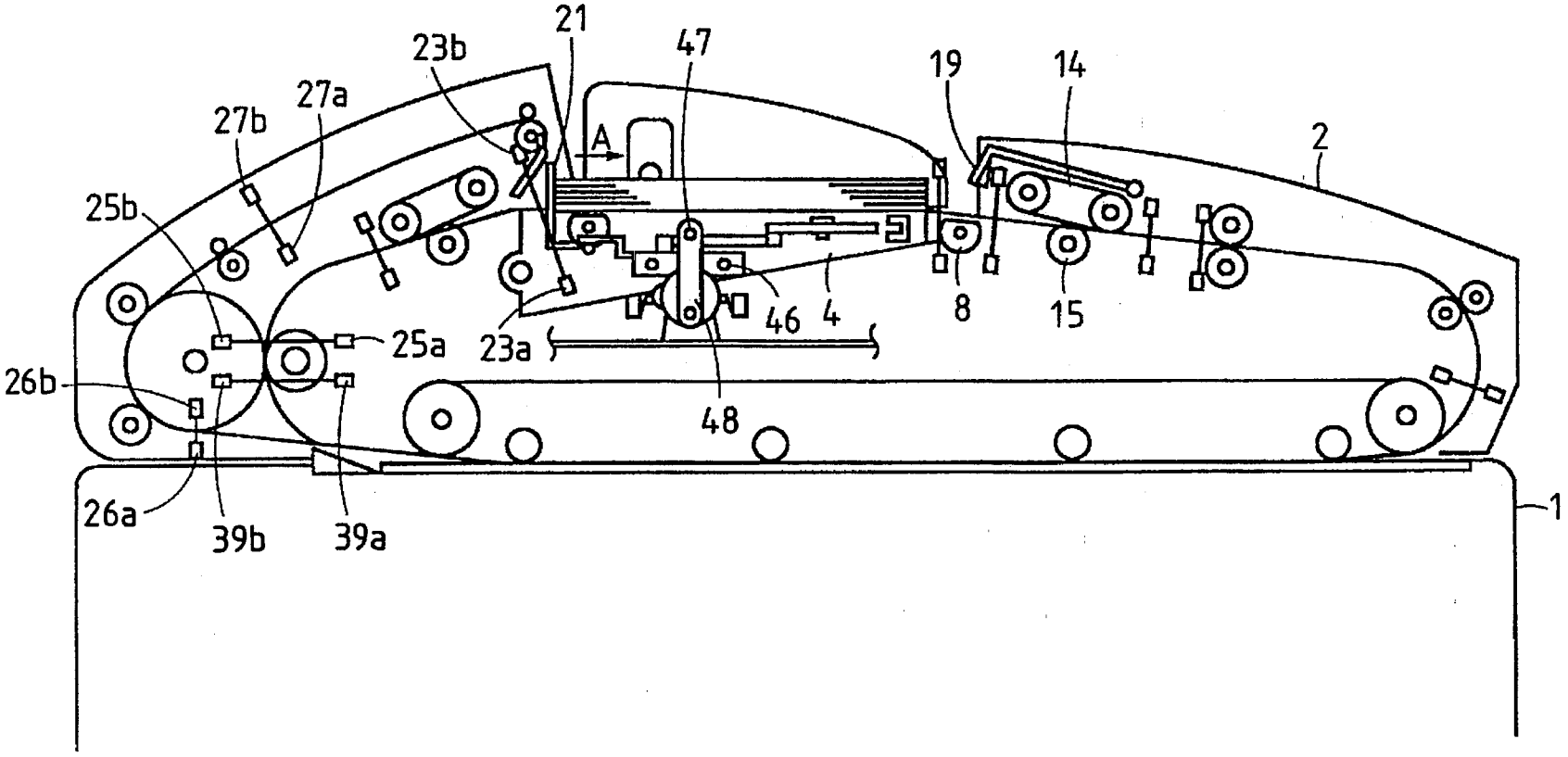
FIG. 2 is a view for explaining the swinging state of an original tray in the sheet transporting device as shown in FIG. 1.
Figure 3:
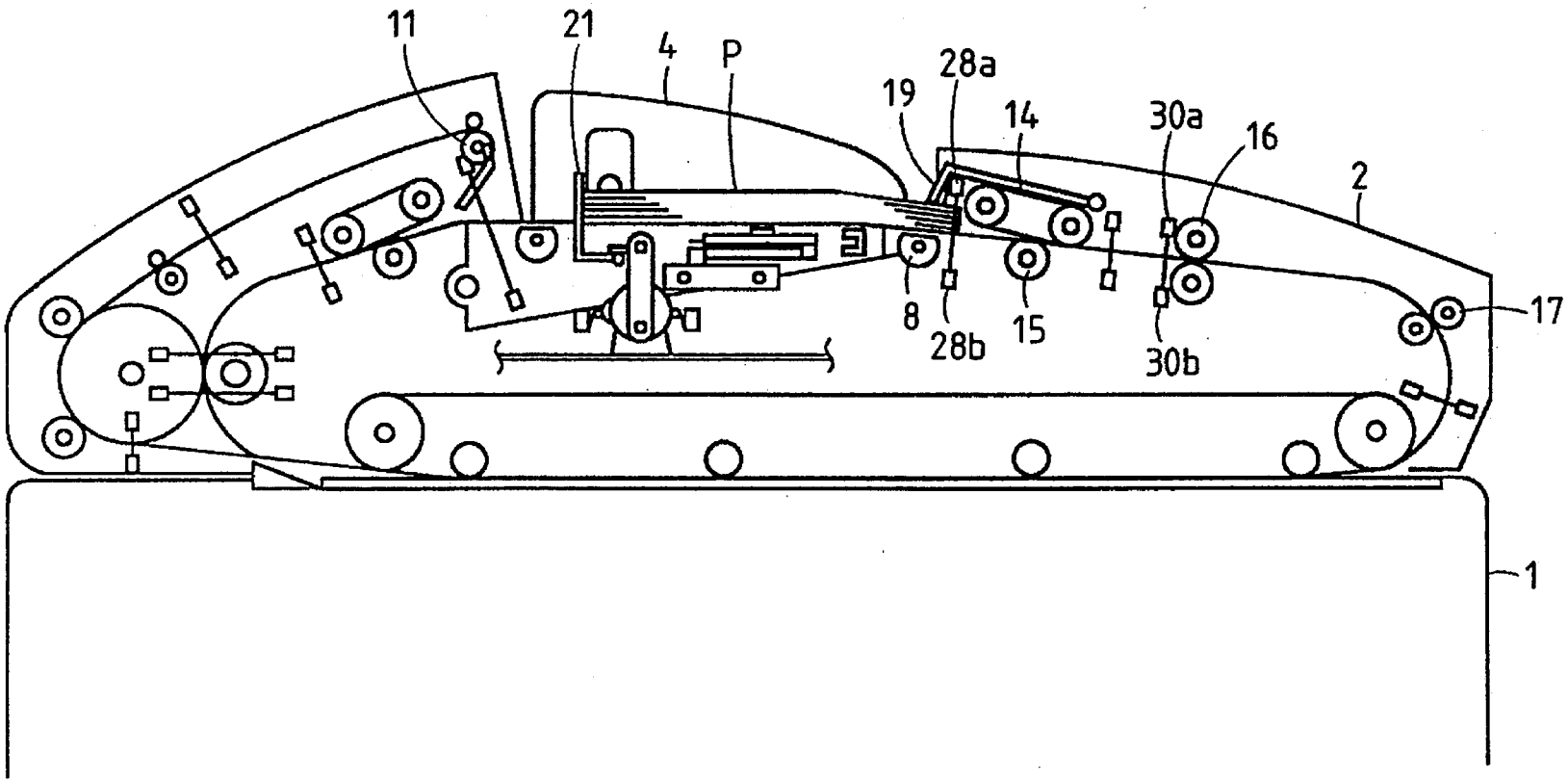
FIG. 3 is a view for explaining the swinging state of the original tray in the sheet transporting device as shown in FIG. 1.

FIGS. 1 to 3 are cross-sectional views for explaining the essential construction of a sheet transporting device (RDF: Recycle Document Feeder) showing one embodiment of the present invention.

As seen from these figures, on an original tray 4, there are disposed a pair of width direction regulating plates 33*a* as hereinafter described and shown in FIG. 13 to be freely slidable in the width direction of the sheet original (original bundle) P, regulating the sheet original P laid on the original tray 4 in the width direction to assure the stability in feeding the sheet original P and the consistency in carrying it onto the original tray 4. The above width direction regulating plates 33*a* contain a jogging mechanism as will be described later, which serves to press each sheet original P carried on the original tray 4 against an original reference guide 33 to enhance the consistency. Further, they are configured to swing between the state of FIG. 1 and the state of FIG. 2 by means of an original tray lifting mechanism as will be described later.

Figure 5:
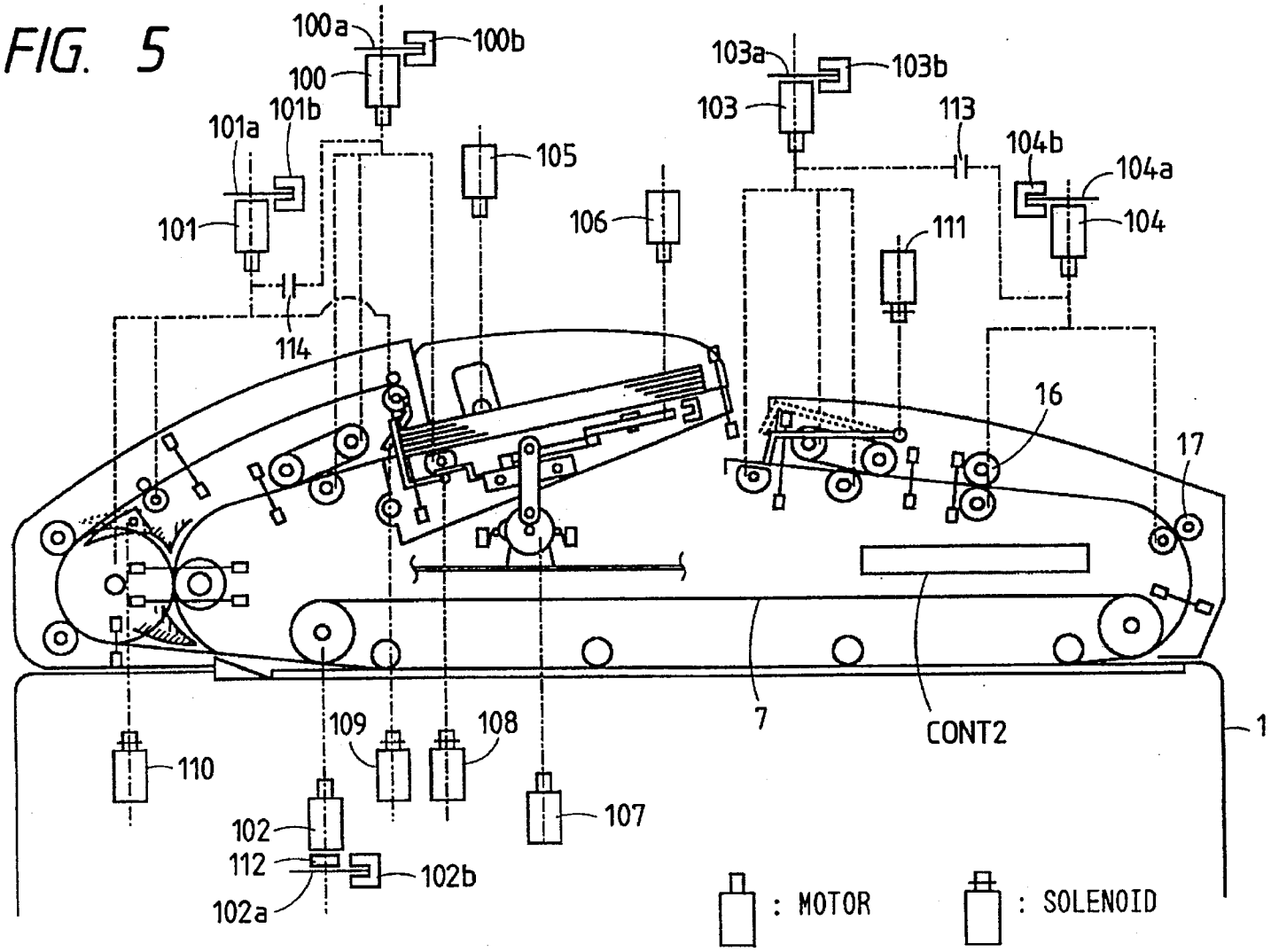
FIG. 5 is a transporting passageway driving organization chart of the sheet transporting device as shown in FIG. 1.

Also, there is disposed a stopper 21, adjacent to the original tray 4, which can be moved vertically by means of a half-moon shaped paper feeding roller 5 and a stopper solenoid 108 (see FIG. 5).

Further, the sheet original P set on the original tray 4 is regulated by the stopper 21 projected to prevent further downward movement thereof. And if the copying conditions are entered in an operation unit of a copying machine, and the start key is depressed, the stopper 21 sinks down to open the course of the sheet original P, so that the sheet original P is fed by the paper feeding roller 5 to proceed downstream. In this case, a partition member connected to a partition member motor 105 (see FIG. 5) contained within the original reference guide 33 on the original tray 4 rides on the uppermost sheet original P by rotating to distinguish between the unexposed original and the exposed original.

Downstream of the stopper 21 are disposed a transporting roller 38 and a separation belt 6 which constitute a separation unit, which serve to separate the sheet original P proceeding from the original tray 4, one by one, each rotating in a direction of the arrow, and to transport it further downstream.

Also, upward of the stopper 21, there is provided a weight 20, wherein if there is too small number of original sheets P on the original tray 4 for the sheet original P to proceed to the separation unit 6, 38 by the feeding power of the paper feeding roller 5, the weight 5 will move downward under the effect of a weight solenoid 109 (see FIG. 5) to carry the sheet original P between it and the paper feeding roller 5 to enhance the feeding power of the paper feeding roller 5.

Further, the weight 20 plays a role of bundle thickness detecting means for an original bundle laid on the original tray 4 which may be a constitution necessary to accomplish the present invention. Note that 24*a*, 24*b*, 25*a*, 25*b*, 39*a* and 39*b* are sensors for detecting the original transporting state.

Figure 4:
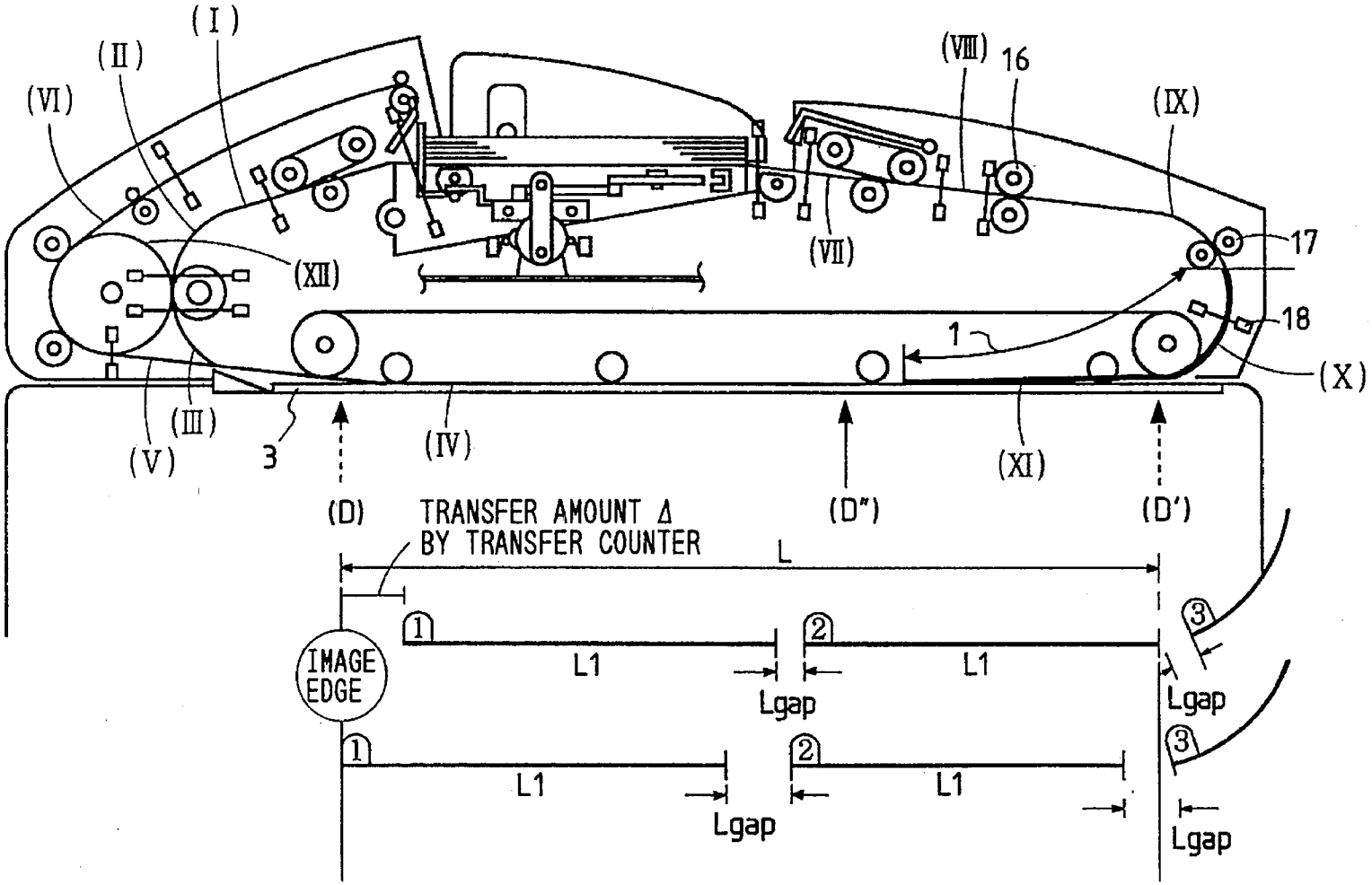
FIG. 4 is a schematic view for explaining a transporting passageway of the sheet transporting device as shown in FIG. 1.

Referring to a transporting passageway chart as shown in FIG. 4 and a transporting passageway driving organization chart as shown in FIG. 5, the operation of the sheet transporting device as shown in FIG. 1 will be described in more detail.

FIG. 4 is a schematic view for explaining the transporting passageway of the sheet transporting device as shown in FIG. 1.

As seen in this figure, original feeding passageways (I), (II) and (III) extend from the separation belt 6, to the platen 3, and flexedly connected to the transporting passageway on the platen 3 to introduce the sheet original P onto the platen 3.

Also, in the neighborhood of the paper feeding roller 5, there are entrance sensors 23*a*, 23*b* which are transmission-type photosensors for detecting the presence or absence of the sheet original P laid on the original tray 4. Leftward of this RDF main body is disposed a large roller 10 to constitute original ejecting passageways (V), (VI) extending from the platen 3 around the outer periphery of the large roller 10 and above the original tray 4.

Further, an original inversion passageway (XII) (see FIG. 4) branching from the original ejecting passageways (V), (VI) and extending over the large roller 10 is constructed to turn the original on the screen upside down, the downstream portion of this original inversion passageway (XII) merging with the original feeding passageway (II) as above mentioned.

Also, on the downstream side of the original ejecting passageway (VI), there are provided a relay roller 44 and a paper ejecting roller 11 to carry the sheet original P transported on the original ejecting passageways (V), (VI) on to the top of original bundle P on the original tray 4. The wide belt 7 disposed above the platen 3 serves to transport and place the sheet original P to a predetermined position on the platen 3, and carry the sheet original from the platen 3 after reading of the image. At a position where the original feeding passageways (I), (II), (III) and the original inversion passageway (XII) are merged is disposed a paper feeding roller 9 to cause the sheet original P that has arrived therein to form a loop to prevent the sheet original P from running skewedly.

Further, in the neighborhood and upstream of the paper feeding roller 9, there are disposed the paper feeding sensors 25*a*, 25*b* which are transmission-type photosensors for detecting the leading end and the trailing end of the sheet original P to allow the detection of the sheet original P which has passed any of the original feeding passageways (I), (II), (III) and the original inversion passageway (XII).

Also, downstream of the paper feeding roller 9, there are disposed resist sensors 39*a*, 39*b* which are transmission-type photosensors for detecting the trailing end of the sheet original P.

Also, downward of the large roller 10 in the original ejecting passageways (V), (VI), there are disposed inversion sensors 26*a*, 26*b* which are transmission-type photosensors for detecting the sheet original P carried from the platen 3, and in the original ejecting passageway (VI) between the large roller 10 and the paper ejecting roller 11, there are disposed paper ejecting sensors 27*a*, 27*b* which are transmission-type photosensors for detecting the sheet original P carried on to the original tray 4 to transit therethrough. Further, an inversion flapper 34 for switching the bus is disposed on a portion branching from the original ejecting passageways (V), (VI) to the original inversion passageway (XII), to switch the bus by turning on or off an inversion flapper solenoid 110 (see FIG. 5 as described hereinafter) to swing between the solid line position and the slanting line position as indicated in the figure.

Further, rightward of the RDF2 main body, there are constructed a second original separating means for transporting the sheet original from the right end of the platen glass 3 on to the platen glass 3 and into an image reading portion on the platen 3, and second original feeding passageways (VIII), (IX), (X), the original tray 4 being allowed to swing between the upper limit position and the lower limit position as indicated in FIGS. 1 and 2 as will be described later.

Also, the original tray 4 is configured to take the upper limit position or the lower limit position, depending on the size of the original laid on the tray and the input conditions of the image forming apparatus. Upon the original tray 4 reaching the lower limit position, the stopper 21 of the original tray 4 moves a bundle of the sheet originals P laid on the original tray 4 toward the second separating means.

As shown in FIG. 3, a half-moon shaped second paper feeding roller 8 and a transporting roller 15 and a separation belt 14 which constitute a second separation portion are disposed adjacent to the original tray 4 placed at the lower limit position, each roller rotating in a direction of the arrow to separate the sheet original P forced out of the original tray 4, one by one, and transport it downstream.

FIG. 5 is a transporting passageway driving organization chart of the sheet transporting device as shown in FIG. 1. In FIG. 5, 100 is a first separation motor which drives a transporting roller 38 and a separation belt 6 which are a separation portion in a direction of the arrow as indicated in the figure. A belt motor 102 drives a driving roller 36 for driving the wide belt 7 looped around the driving roller 36 and a turn roller 37. Also, a brake 112 is provided on a motor shaft of the belt motor 102 to stop the wide belt 7 at a correct position. An inversion motor 101 drives the large roller 10 and the paper ejecting roller 11. 103 represents a second separation motor, this separation motor 103 driving a transporting roller 15 and a separation belt 14 which are a second separation portion in a direction of the arrow as indicated in the figure. 114 is a clutch.

104 is a transporting motor which drives a second feeding roller 16 and a relay roller 17. On the shaft of each motor, there are provided clock disks 100*a*, 101*a*, 102*a*, 103*a*, 104*a* with a plurality of slits formed, and clock sensors 100*b*, 101*b*, 102*b*, 103*b*, 104*b* for generating pulses by recognizing each of the slits through the transmission-type photosensor.

Note that by counting the rotations of each motor in clocks through the clock sensors 100*b*, 101*b*, 102*b*, 103*b*, 104*b*, the amount of rotation of each transporting roller can be measured, and thus the amount of movement of the sheet original P can be determined.

110 represents an inversion flapper solenoid for swinging the inversion flapper 34, wherein the inversion flapper 34 is placed in the position as indicated by the solid line in the figure when in the OFF state, to carry the sheet original P that has passed through the original ejecting passageways (V), (VI) on to the original tray 4, or introduces the sheet original P passing through the original ejecting passageways (V), (VI) on to the original inversion passageway (XII) when in the ON state.

Figure 6:
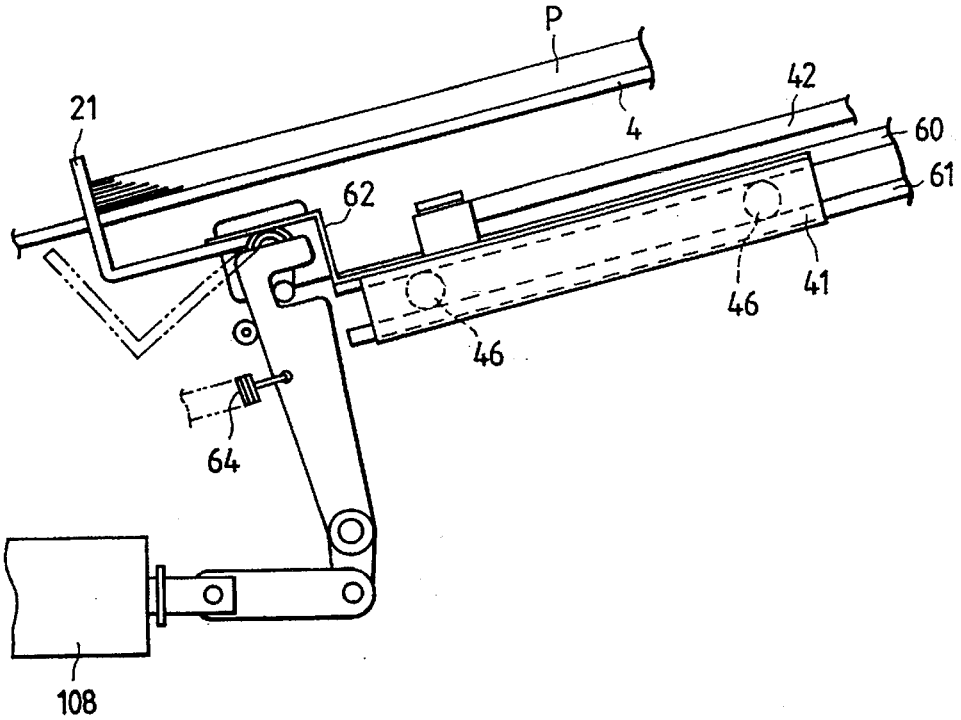
FIG. 6 is a detailed view for explaining a swinging mechanism of the original tray as shown in FIG. 1.

A stopper solenoid 108 drives the stopper 21 to move vertically via arms 58 and 59 (FIG. 7) as indicated in FIG. 6, wherein the stopper 21 is placed in a position as indicated by the solid line in FIG. 6 by the force in the return direction of a spring 64 and the force in the direction of pushing up the stopper 21 of a spring 66 when in the OFF state to a prevent the original bundle P on the original tray 4 from shifting further downstream, or sinks down to open the course of the sheet original P (at a position indicated by the two-dot chain line) when in the ON state.

109 is a weight solenoid to swing the weight 20 vertically, wherein the weight 20 is placed in a position as indicated when in the OFF state, or lowered down to press the sheet original P onto the paper feeding roller 5 to enhance the transporting force with the paper feeding roller 5 when in the ON state. 111 represents an original stopper solenoid to swing an original stopper 19 vertically, wherein this original stopper is placed in a position as indicated by the solid line in the figure when in the OFF state, or rises up to a position as indicated by the broken line in the figure when in the ON state.

In a sheet transporting device thus constituted, transporting control means (controller CONT2) controls the transporting speed of the second transporting means (a motor 104 for driving the rollers 16, 17 in this example) to be higher than the transporting speed (original reading speed) set on the first transporting means (a motor 102 for driving the belt 7 in this example) (following a right side after-separation process as will be described later and shown in FIG. 22), so that, when reading the original while transporting the original sheet continuously, the original sheet can be transported continuously without troubles in sufficient time for the feeding interval of the recording sheet in the continuous paper feeding operation.

Also, transporting control means judges the end state of the original sheet delivered via the separation means to transport the original sheet at a transporting speed beyond which that of the second transporting means becomes higher than the reading speed of the original set on the first transporting means, whereby the speed of the original sheet is kept constant until the original sheet is separated securely, thereby preventing any damage to the original.

Referring now to FIG. 5, the swinging operation of the original tray 4 will be described below.

107 is a tray swinging motor, with a motor output shaft being connected to a tray swinging arm 48. Engaged with the lower surface of the original tray 4 is a tray swinging shaft 47. The tray swinging shaft 47 engages the top end of the tray swinging arm 48, the opposite side of the tray swinging arm 48 being secured to a tray swinging arm shaft 48', whereby the tray swinging arm 48 is swung between the states of FIGS. 1 and 2 with the rotation of the tray swinging arm shaft to swing the original tray 4 around a swinging center 40.

51 is an upper limit switch for detecting the original tray 4 to have reached the upper position, and 52 is a lower limit switch for detecting the original tray 4 to have reached the lower position, wherein the tray swinging motor 107 is controlled for rotation by the detection of the upper and lower limit switches 51, 52.

Referring now to FIG. 5, bundle transferring means on the original tray 4 will be described below.

106 is a stopper slide motor to move the stopper 21 in a direction of the arrow A in FIG. 2, to transfer the sheet original P to the second separation portion, and move it back to the initial position on the left side after transfer.

Figure 9:
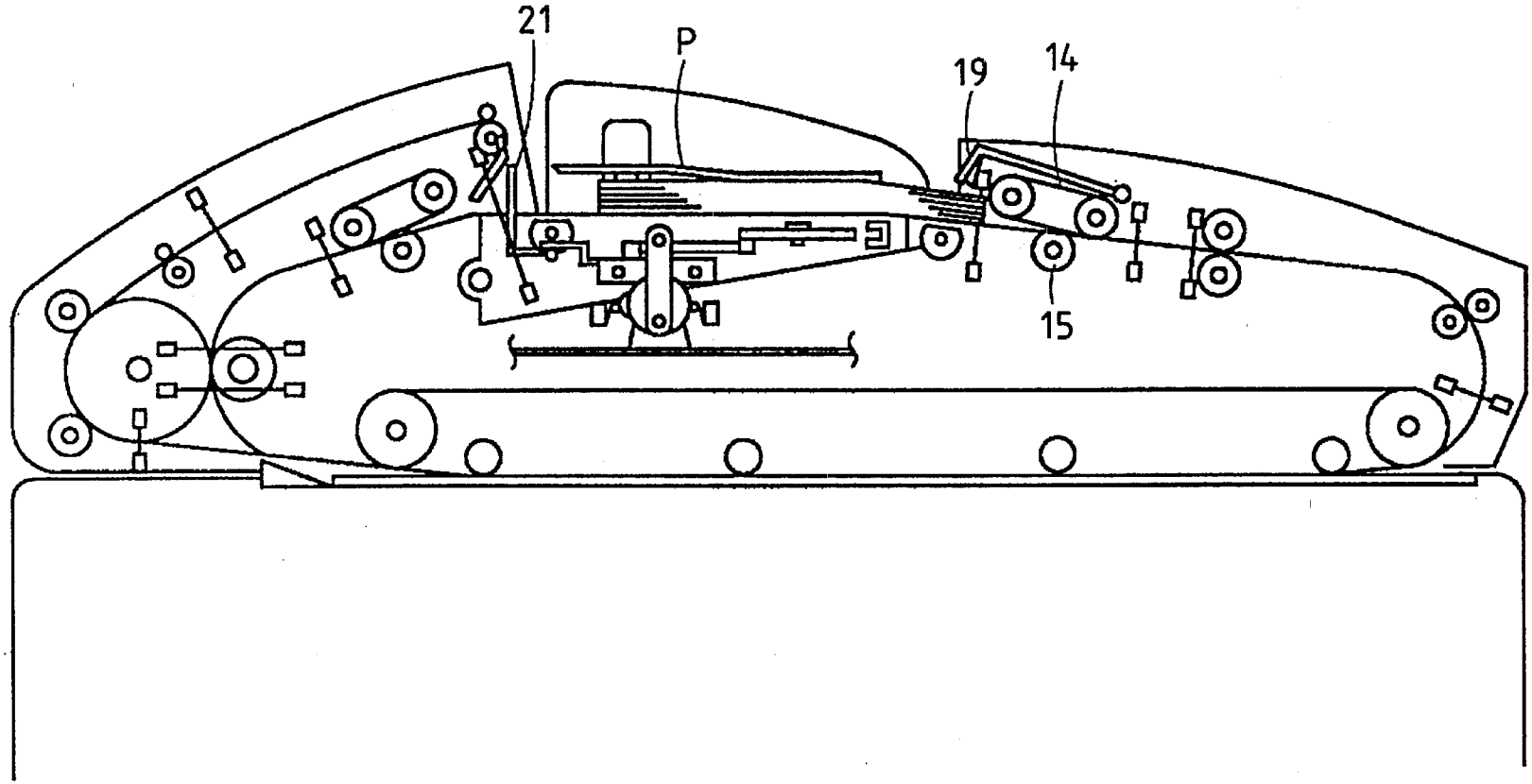
FIG. 9 is a view for explaining a stopper mechanism of the original tray as shown in FIG. 1.
Figure 10:
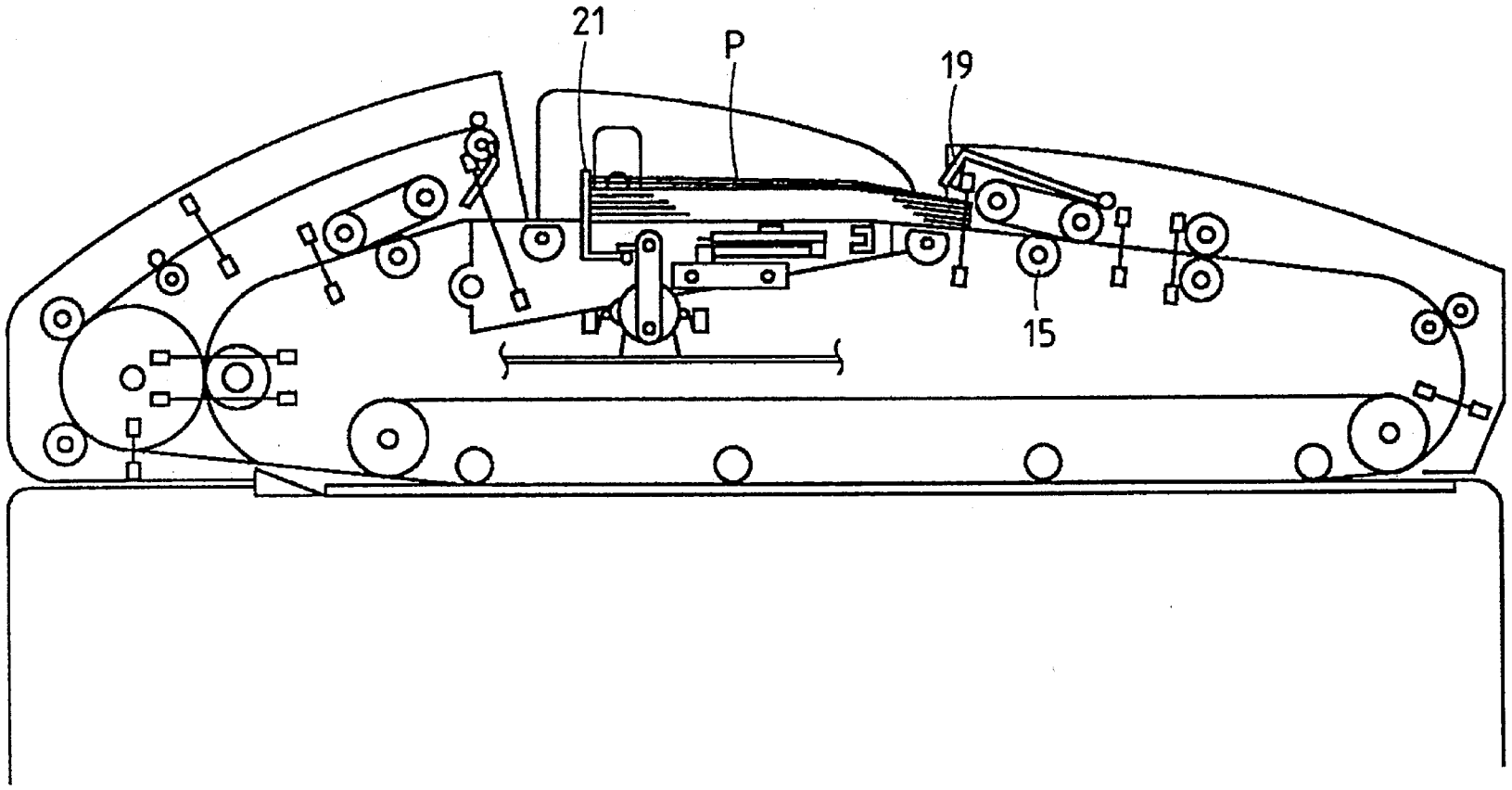
FIG. 10 is a view for explaining the stopper mechanism of the original tray as shown in FIG. 1.

Also, by moving the stopper 21 from the position of FIG. 9 to the position of FIG. 10 every time the sheet original is ejected from the paper ejecting roller 11 on to the original tray 4, the stopper 21 forces the trailing end of the sheet original ejected into the second separation portion, thereby enhancing the consistency of the sheet original P on the original tray 4 in the transporting direction.

Referring to FIGS. 6 to 8A, 8B, the swinging mechanism and the swinging operation of the original tray 4 will be described below.

FIGS. 6 to 8A, 8B are views for explaining the swinging mechanism and the swinging operation of the original tray 4 as shown in FIG. 1.

Figure 7:
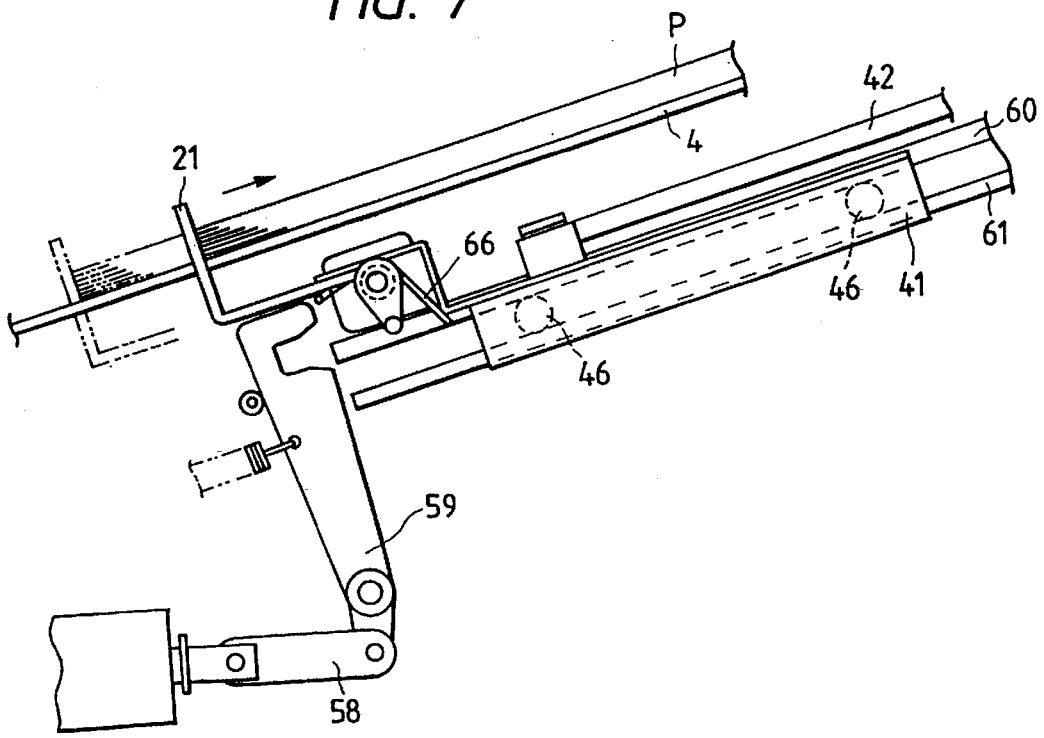
FIG. 7 is a detailed view for explaining the swinging mechanism of the original tray as shown in FIG. 1.
Figure 8A:
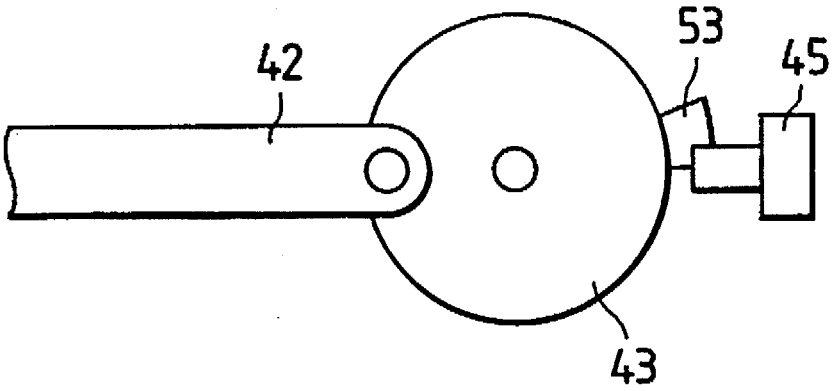
FIGS. 8A and 8B are detailed views for explaining the swinging mechanism of the original tray as shown in FIG. 1.
Figure 8B:
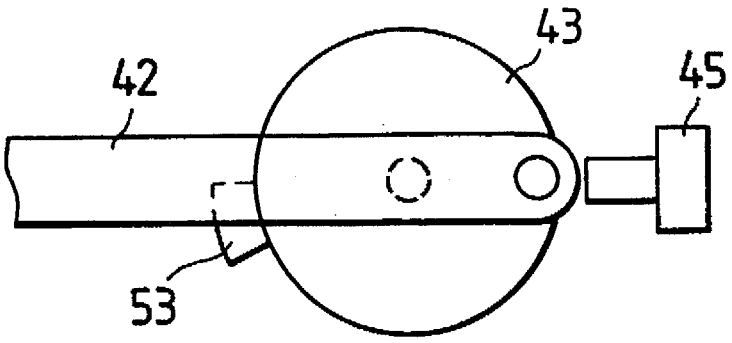

As shown in FIG. 6, a member 62 transmits the movement of a stopper slide base 41 to stopper 21, so as to move stopper 21 in a right or left direction (FIG. 7), a stopper slide base 41 moves on a roller 46 within the guides 60, 61 (see FIG. 6) disposed on the original tray 4, via a link 42 by the rotation of an eccentric cam 43 (see FIGS. 7 and 8A, 8B). The eccentric cam 43 is provided with a flag 53 and a transmission-type sensor 45 for detecting the home position (FIGS. 8*a* and 8*b*). When the original tray 4 reaches the lower limit position, the sheet original stopper 19 is swung upward around a supporting axis 31 by virtue of the solenoid 111 (see FIG. 5), to accept a bundle of the sheet originals P transferred in bundle by the bundle transferring means. The bundle of sheet originals P transferred in bundle is necessarily transported to a position to detect the presence of sheet through the transmission-type photosensors 28*a*, 28*b* for detecting whether or not the sheet original is present, which are disposed in the neighborhood and upstream of the second separation means (see FIG. 3).

If the bundle transfer is completed, the sheet original stopper 19 is placed on the sheet original P. Downstream of this second separation means is disposed a second feeding roller 16, forming a loop in the sheet original P which has arrived therein to prevent the sheet original P from running skewedly. In the neighborhood and upstream of the second feeding roller 16, there are disposed second feeding sensors 30*a*, 30*b* which are transmission-type photosensors for detecting the leading end and the trailing end of the sheet original P.

Further, a relay roller 17 is provided downstream, and there are disposed transmission-type image edge sensors 18*a*, 18*b* for detecting the leading end position of the sheet original P in the second feeding passageway X, to make the timing control of the sheet member on which an image is formed within the image forming device.

Referring now to FIGS. 9 and 10, a stopper mechanism of the original tray 4 as shown in FIG. 1 will be described below.

FIGS. 9 and 10 are views for explaining the operation of the stopper mechanism of the original tray 4 as shown in FIG. 1.

Figure 11:
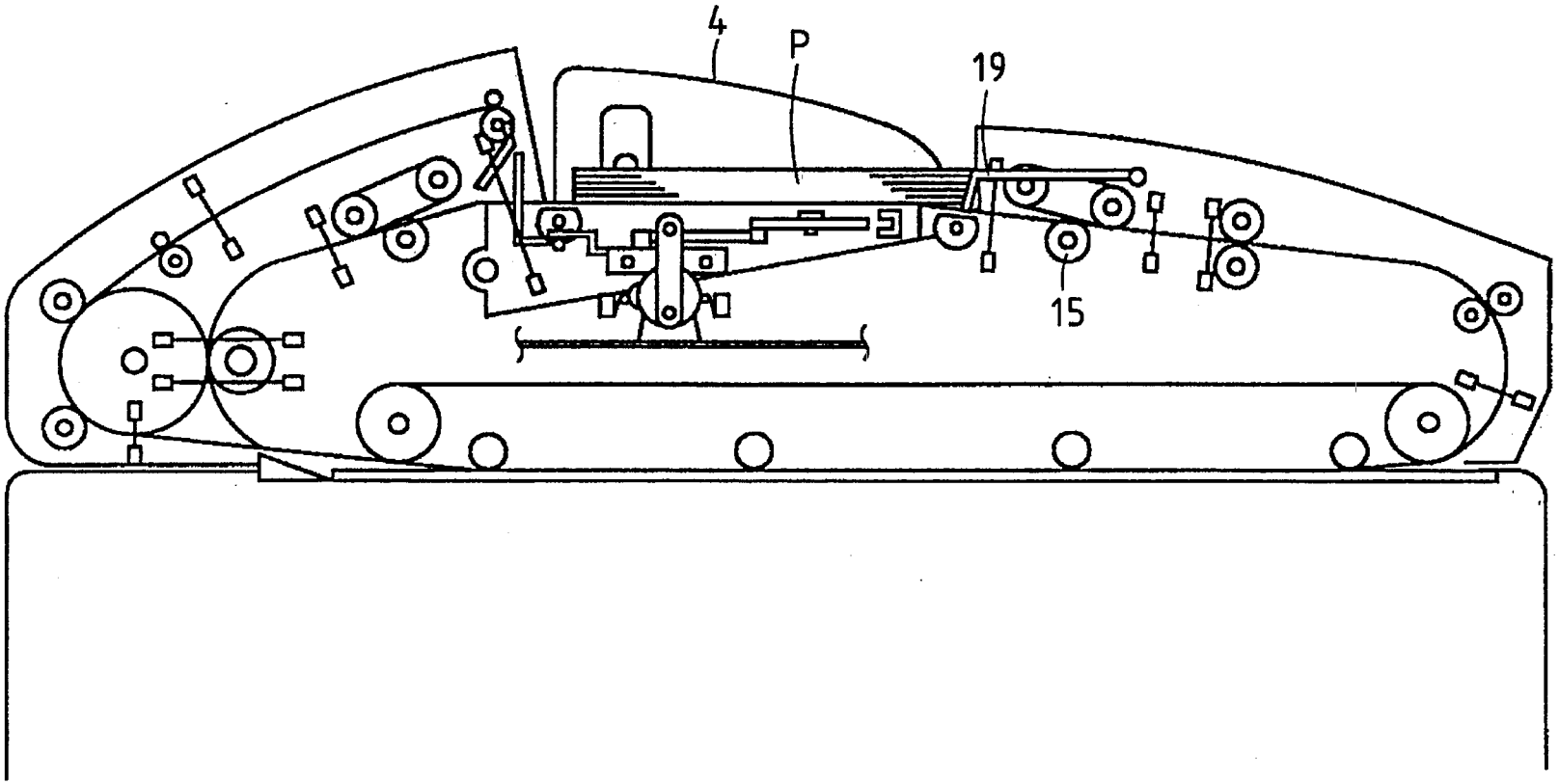
FIG. 11 is a view for explaining the stopper mechanism of the original tray as shown in FIG. 1.

As shown in these figures, if a sheet on the bottom is separated and transported by the rotation of the second transporting roller 15, with the number of copies for formed image being set to one by an input key in the image forming device, the sheet original stopper 19 remains on the sheet original P, as shown in FIG. 3, to regulate the sheet original ejected by the paper ejecting rollers 11, 12, 13 not to enter the second separation portion. And when the number of copies for formed image is set to n by the input key in the image forming device (one set of sheet originals cycled n times), the sheet original stopper 19 is retreated upward until the set of sheet originals is cycled (n−1) times, as shown in FIGS. 9 and 10, and when the first sheet original at the n-th cycle is reloaded on the original tray 4, the sheet original stopper 19 is placed on the sheet original to regulate the first sheet original not to enter the second separation portion. At the completion of n cycles, the sheet original P has its top end regulated by the sheet original stopper as shown in FIG. 11. Thereafter, the original tray 4 is moved upward, and stopped at the upper limit position. Note that when the number of copies for formed image is set to one by the input key in the image forming device, the original also has its top end regulated by the sheet original stopper 19 as shown in FIG. 11.

Figure 12A:
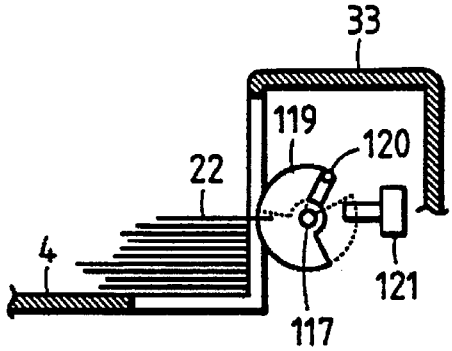
FIGS. 12A and 12B are cross-sectional views for explaining the constitution of a partition member of the original tray as shown in FIG. 1.
Figure 12B:
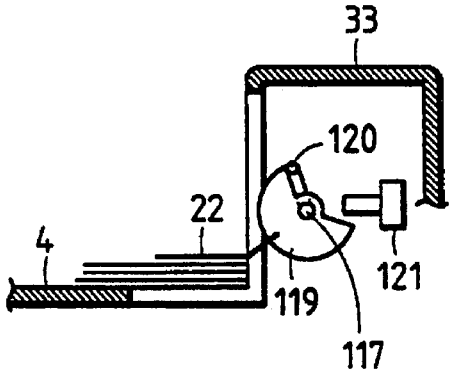

Referring now to FIGS. 12A and 12B, a partition member of the original tray 4 as shown in FIG. 1 will be described below.

FIGS. 12A and 12B is a cross-sectional view for explaining the construction of a partition member 22 of the original tray 4 as shown in FIG. 1.

In the figure, on a shaft 117 of a partition member motor 105 as shown in FIG. 5, there are disposed coaxially a notched disk 119 freely supported in a rotational direction, and a partition lever 120, secured to the shaft 117, for driving in rotation the notched disk 119.

The disk 119 is partially cut on its circumference as shown, and the partition member 22 made of a flexible material such as polyester film or a leaf spring secured on to the circumference to be rotatable on the shaft 117 integrally with the disk 119.

Also, the disk 119, which has its center of gravity position toward the partition member 22, stops at a position where the partition member 22 falls down due to its dead weight, when the driving of the partition lever 120 is not applied. 121 represents a partition sensor to judge the position of the partition member 22 by detecting the disk 119.

As shown in FIG. 12A, when the sheet originals P are fully loaded on the original tray 4, the partition member 22 is not deformed and becomes flat over the sheet original P as shown in the figure, since the distance from the end face of the sheet original P to the affixing portion of the partition member 22 is short, and the nerve of the partition member 22 is strong.

On the other hand, when there is a small number of sheet originals P loaded on the original tray 4, as shown in FIG. 12B, the partition member is stopped with the top end of the member in contact with the surface of the sheet original P if the partition member has a rigidity as conventionally, so that the partition member will float with a clearance from the original surface at the end position of the original. And upon reloading the sheet original P on the partition member, the leading end of the original may collide with the partition member so that the original sheet can not be loaded on the original tray 4 stably, but because the partition member 22 has flexibility as shown in FIG. 12B, the partition member 22 becomes conformed to the state of the surface of the original bundle P by the driving force of partition lever 120, and becomes flat over the original surface in the same manner as when fully loaded.

Accordingly, the partition member 22 necessarily becomes closely contacted with the surface of the original bundle P, irrespective of whether or not there is a large number of sheet originals P on the original tray 4, so that even if the sheet original P is reloaded on the partition member 22, there occurs no collision of the sheet original against the partition member 22, whereby the sheet original P can be loaded stably without causing troubles in carrying the sheet original P.

Figure 13:
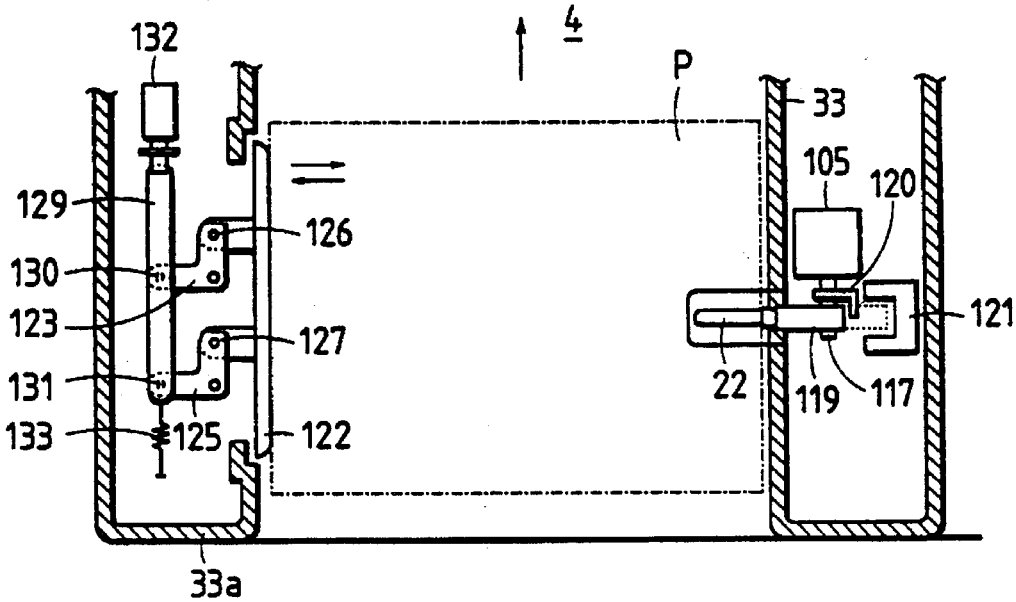
FIG. 13 is a view for explaining a jogging mechanism of the original tray as shown in FIG. 1.

Referring now to FIG. 13, a jogging mechanism of the original tray 4 will be described below.

FIG. 13 is a view for explaining the jogging mechanism of the original tray 4 as shown in FIG. 1.

In the figure, 122 is a jogging guide forming a part of the width direction regulating plate 33*a*, supported to freely retract into or emerge from the width direction regulating plate 33*a*. On the opposite side of the jogging guide 122 to the side of the original face, there are provided link pins 126, 127 which engage two jogging links 123, 125, respectively. The other ends of the jogging links 123, 125 are engaged with a jogging lever 129 at lever pins 130, 131, respectively.

Also, the jogging lever 129 is engaged with a jogging solenoid 132. Accordingly, if the jogging solenoid 132 is turned on, the jogging guide 122 is operated to press the sheet original P against the original reference guide 33, while if the jogging solenoid 132 is turned off, the jogging guide 122 is operated to leave away from the original end face by means of a return spring 133.

That is, the sheet original P can be securely pressed onto the original reference guide 33 by repeatedly turning on or off the jogging solenoid 132 every time the sheet original P is reloaded on the original tray 4, one by one, thus enhancing the consistency of the sheet original P on the original tray 4.

Also, engaged with the width direction regulating plate 33*a* is a slide volume (not shown), which allows the size information of the sheet member across the width laid on the original tray 4 to be obtained with the movement of the width direction regulating plate 33*a*.

Also, a sheet length detecting sensor 68 is attached on the rear end of the original tray 4, as shown in FIG. 1, this sheet length detecting sensor (e.g., a reflection-type sensor) judging whether the sheet member is equal to or greater than LTR size (216 mm), or equal to or less than LTR size (216 mm), for example.

When this sheet length detecting sensor 68 judges that the sheet is equal to or greater than LTR size, or even equal to or less than LTR size, the sheet member laid on the original tray 4 is fed by the first separation means, if the set number of copies (keyed in by the image system apparatus operation unit) is 1 and the number of originals is judged to be not more than about 4 sheets by the bundle thickness detecting method (i.e., a switch back pass mode).

On the other hand, when the sheet length detecting sensor 68 judges that the sheet is equal to or less than LTR size (when the entrance sensors 23*a*, 23*b* are on, and the sheet length detecting sensor 68 is off), the upper value of the sheet size in the width direction is obtained by the slide volume 80 moving along with the width direction regulating plate 33*a*, judging whether or not the sheet is of A4, LTR size. When the sheet is of A4, LTR size, with the set number of copies equal to or greater than 2, and when the sheet is of A4, LTR size, with the set number of copies equal to 1, and the number of originals is judged to be not less than about 5 by the bundle thickness detecting method, the original tray is lowered to satisfy the conditions of feeding from the second separation means.

Further, it is judged whether the feeding of paper is made from the first separation means or the second separation means, based on the image forming mode to be input in the image forming device (e.g., in a screen mode, the sheet is fed from the side of the large roller 10 forming the path for the original inversion via the switch back path, that is, from the side of the first separation means). And for other than the A4, LTR size, and when the set number of copies is 1, and the number of originals is not more than about 4, the sheet is fed from the side of the first separation means. Note that the reference for the size of the sheet member is simply one example of the present invention, and the reference value of the size can be arbitrarily chosen.

Figures 14, 14A:
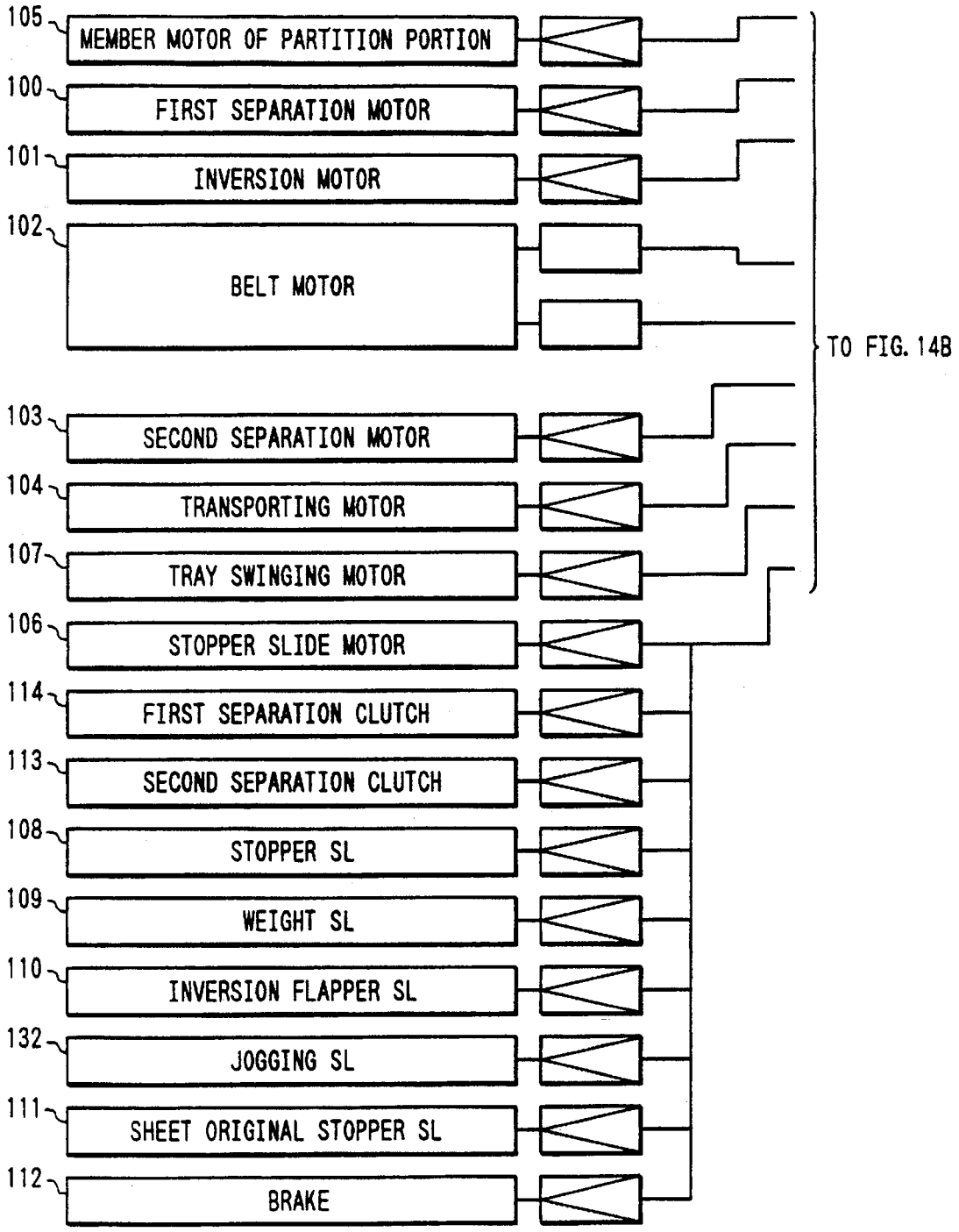
FIG. 14 which is comprised of FIGS. 14A and 14B is a control block diagram for explaining the detailed configuration of a controller as shown in FIG. 5.
Figure 14B:
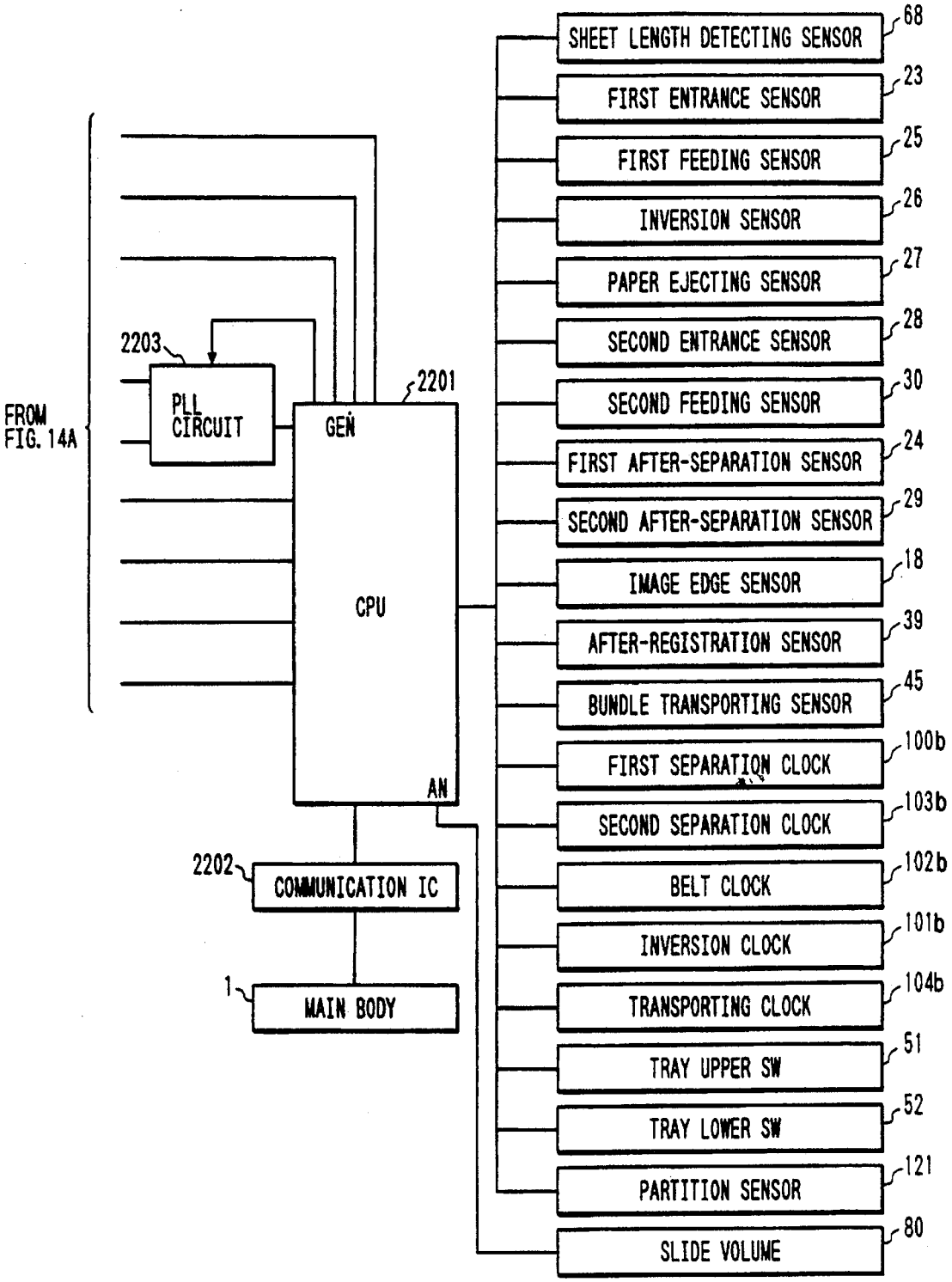

FIG. 14 is a control block diagram for explaining the detailed configuration of a controller CONT2 as shown in FIG. 5, wherein the same reference numerals are attached to the same parts as in FIG. 5.

In the figure, 2201 is a one-chip microcomputer (micro) containing CPU, ROM, RAM and so on, various kinds of sensor signals being input into an input port of the micro 2201.

The slide volume 80 for detecting the original width is connected to an analog/digital conversion terminal of the micro 2201, wherein the value of the slide volume can be continuously detected at 255 steps.

Further, each load is connected to an output port of the micro 2201 via a driver. In particular, a belt motor 102 is connected to a well-known PLL circuit 2203 via a forward/reverse rotation driver, wherein the PLL circuit 2203 has a rectangular wave signal having any frequency input from a rectangular wave output terminal GEN of the micro 2201, and by changing the frequency of this signal, the peripheral speed of the belt motor 102 and further the wide belt 7 can be arbitrarily varied.

Further, control data is sent to or received from the controller CONT1 of the copying machine main body via a communication IC 2202, wherein received data may include the flow reading speed data (v) from the copying machine main body 1, the original transporting mode data such as one side/both side/flow reading, the original feeding trigger, the original exchange trigger, and the original ejecting trigger, and further, the transmission data may include various operation completion signals for the original feeding/exchange/ejection, the size data of detected original, the final original signal informing the breakpoint of original bundle, and the image edge signal in the flow reading mode.

Also, the ROM of the controller CONT2 contained in the micro 2201 has stored control means (control program) as shown in a flowchart and will be described later, in accordance with which each of input and output is controlled.

Referring now to each of the flowcharts as shown in FIGS. 15 to 32, the sheet processing operation in the sheet transporting device according to the present invention will be described below.

Figure 15:
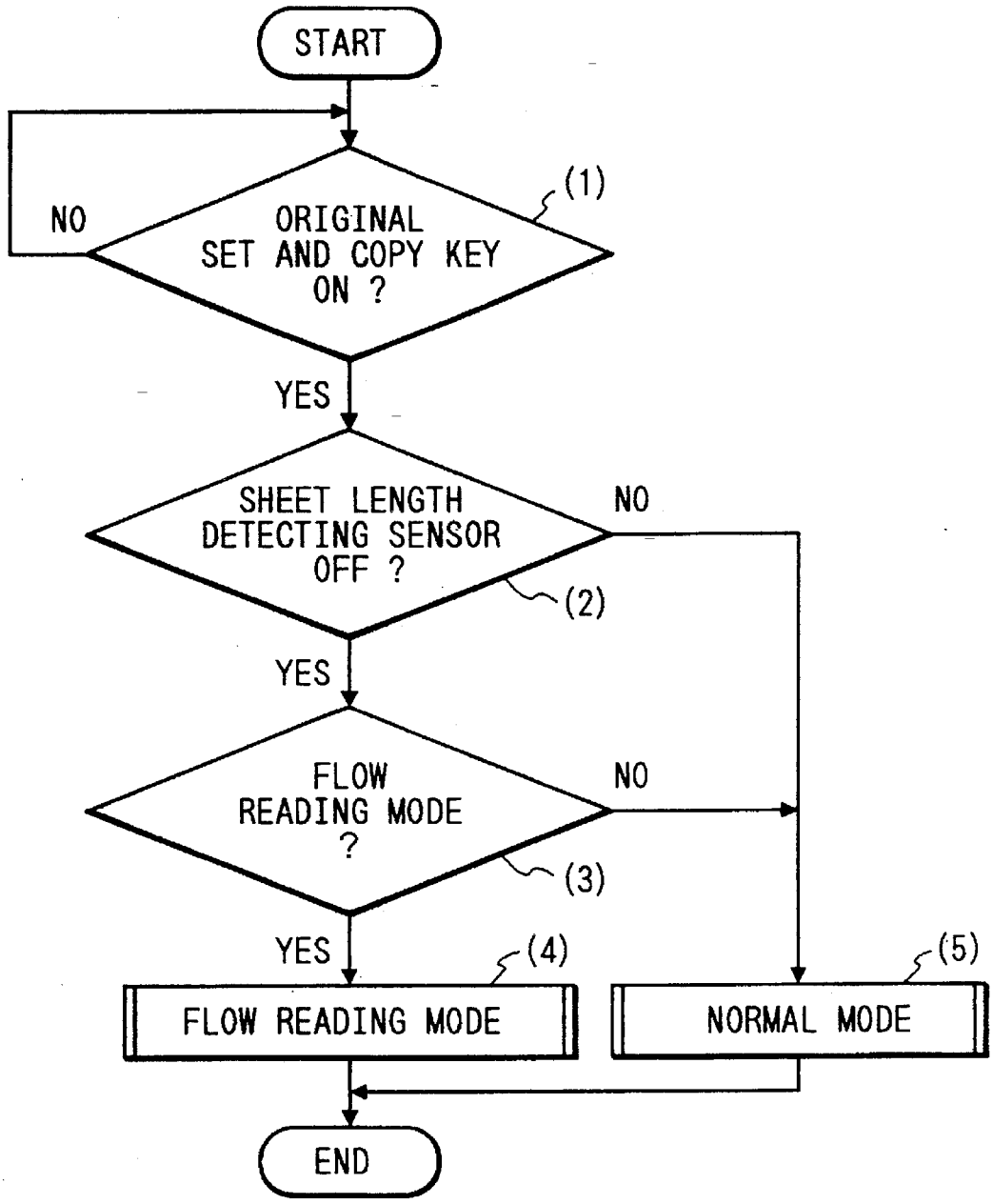
FIG. 15 is a flowchart showing an example of an overall control procedure in the sheet transporting device.

FIG. 15 is a flowchart showing one example of the overall control procedure in the sheet transporting device according to the present invention. Note that (1) to (5) indicate each step.

The sensors 23*a*, 23*b* as shown in FIG. 2 detect whether or not the original is set, and by depressing a copy key in the operation unit of the main body 1 (not shown), the image forming process is started (1). At this time, a check (2) is made to determine whether the sheet length detecting sensor 68 is off (i.e., it is turn off when the sheet size is equal to or less than A4, LTR size). If yes, a further check (3) is made to determine whether the original transporting mode sent from the main body 1 is the flow reading mode. If yes, an image forming processing routine based on the flow reading mode as will be described later is executed (4), and then the processing is ended.

On the other hand, if both decisions of steps (2) and (3) are no, a series of image forming processing routines based on the normal switch back mode is executed (5), and then the processing is ended.

Note that the mode selection with the original size is regulated only by the feeding direction which is determined by the sheet length detecting sensor 68 (see FIG. 1) turning on or off in this embodiment, but the mode selection with the original size may be regulated by a combination with original width detecting means comprised of a slide volume equipped under the original tray (not shown), as previously described.

Figure 16:
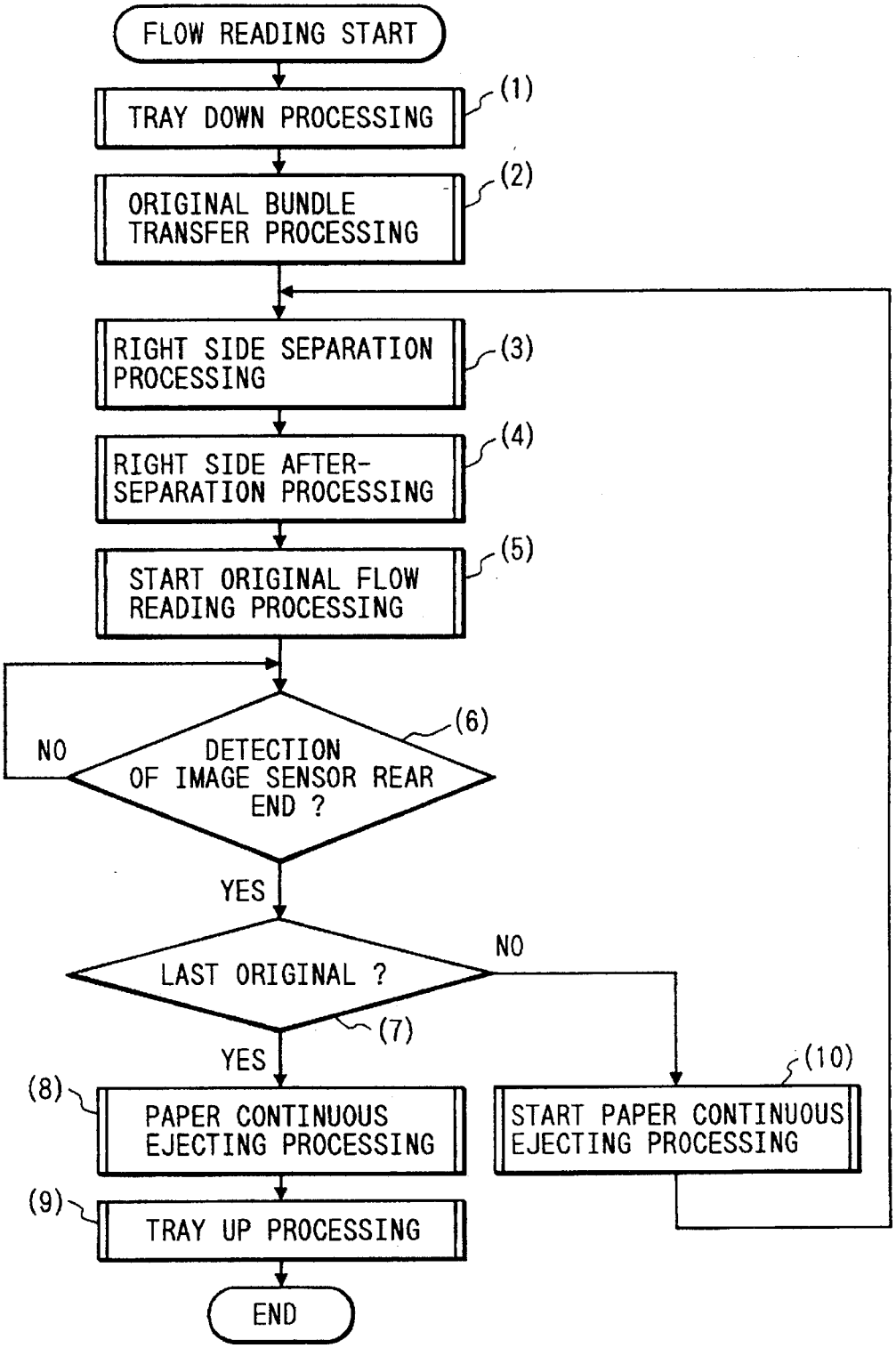
FIG. 16 is a flowchart showing an example of an image processing routine based on a flow mode in the sheet transporting device.

FIG. 16 is a flowchart showing an example of an image processing routine based on the flow reading mode in the sheet transporting device according to the present invention. Note that (1) to (10) indicate each step.

Figure 19:
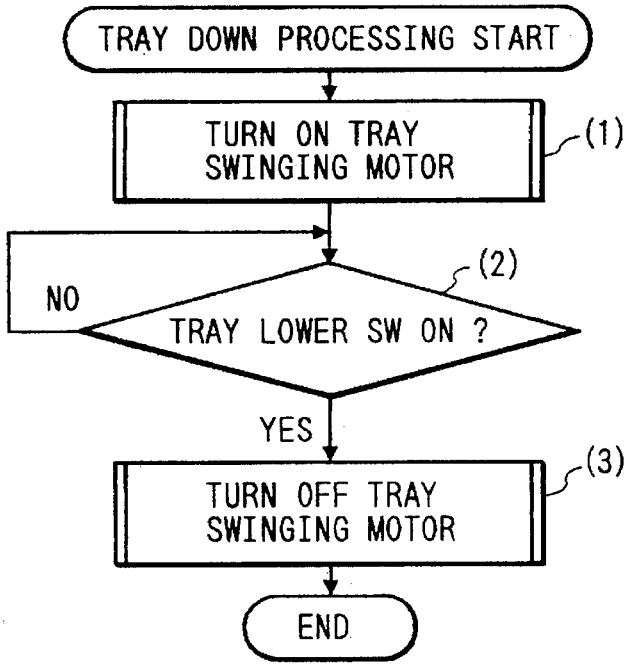
FIG. 19 is a flowchart showing a tray down processing procedure in the sheet transporting device.
Figure 20:
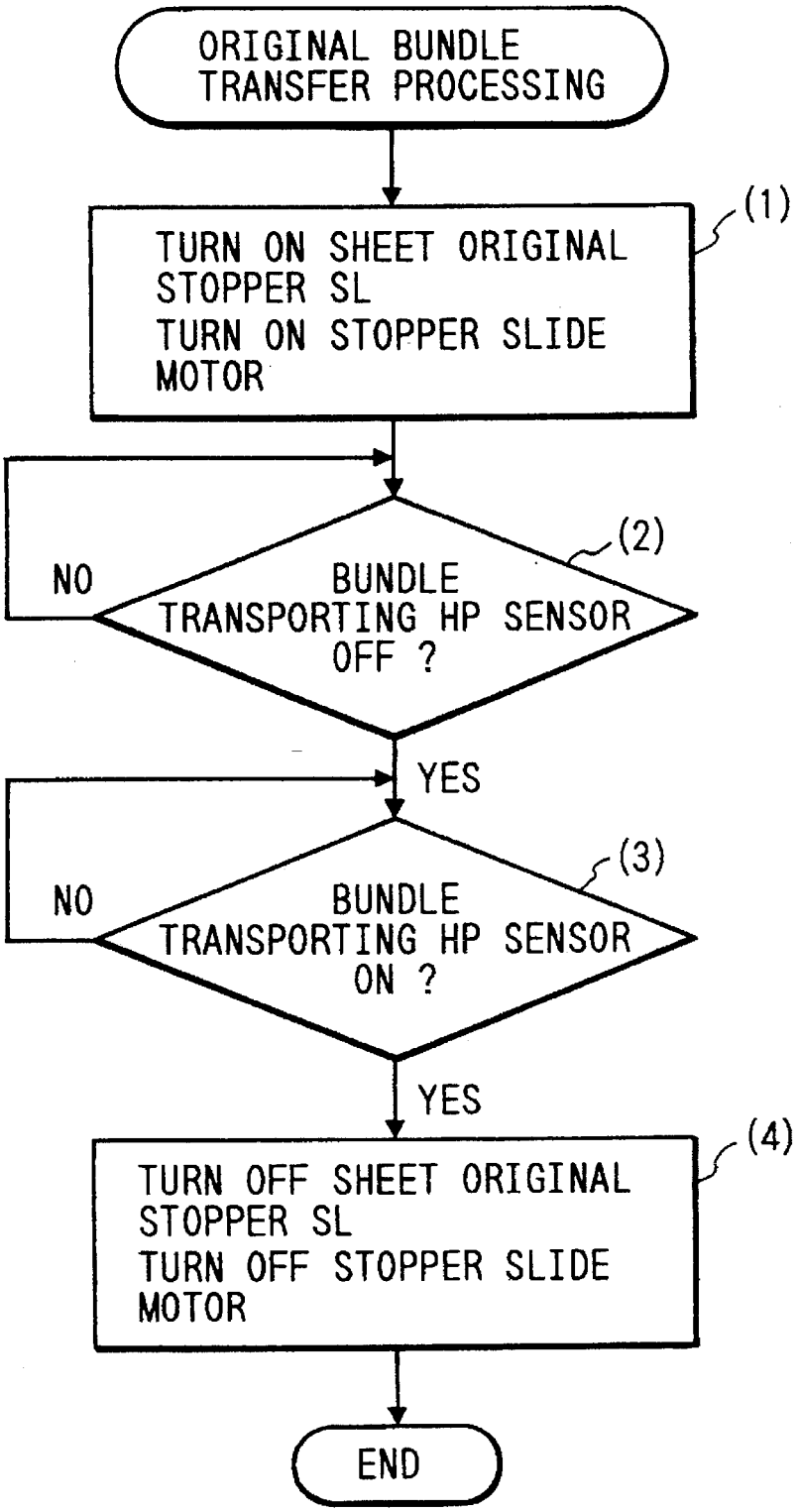
FIG. 20 is a flowchart showing an example of a bundle transporting processing procedure in the sheet transporting device.
Figure 23:
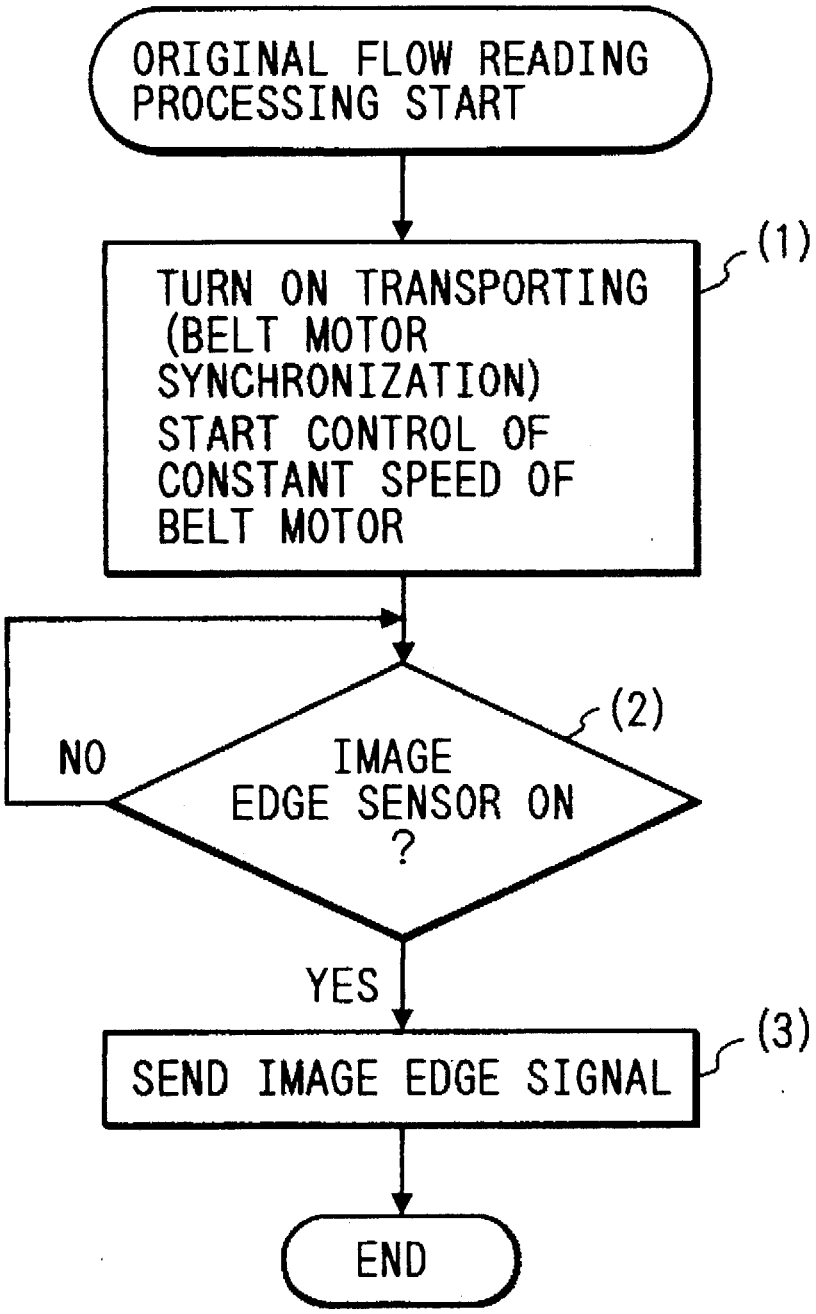
FIG. 23 is a flowchart showing an example of an original flow reading processing procedure in the sheet transporting device.
Figure 24:
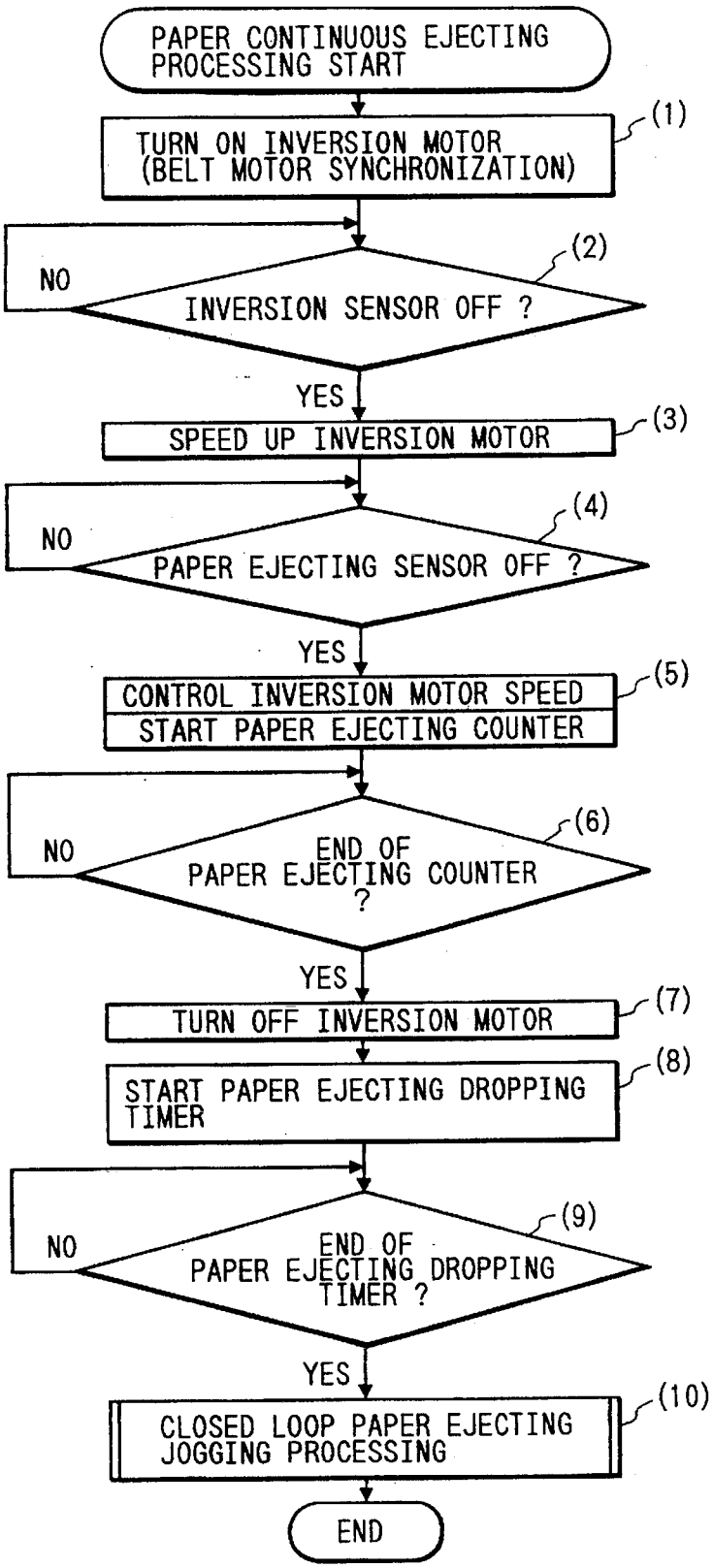
FIG. 24 is a flowchart showing an example of a continuous paper ejection processing procedure in the sheet transporting device.

A tray down processing (1) (following a flowchart as shown in FIG. 19 and will be described later) is executed to move the original tray 4 as shown in FIG. 1 to the lower limit position. Further, an original bundle transfer processing (2) (following a flowchart as shown in FIG. 20 and will be described later) is executed to move the original bundle P to the right side. Then, a right side separation processing (3) (following a flowchart as shown in FIG. 22 and will be described later) is executed to separate only one original sheet lying on the bottom. Thereafter, a right side after-separation processing (4) (following a flowchart as shown in FIG. 22 and will be described later) is executed. Then, an original flowing processing (5) (following a flowchart as shown in FIG. 23 and will be described later) in which original image is read with the optical system of the main body 1 fixed at a predetermined position is started. Then, the operation waits for the trailing end of the original to be detected by the image edge sensor 18 (6). Then, the breakpoint of the original bundle P is detected by the original partition sensor 121, and if not the last original, a continuous paper ejection processing (10) (following a flowchart as shown in FIG. 24 and will be described later) is started to return the original on to the original tray, and then the procedure returns to step (3).

Figure 18:
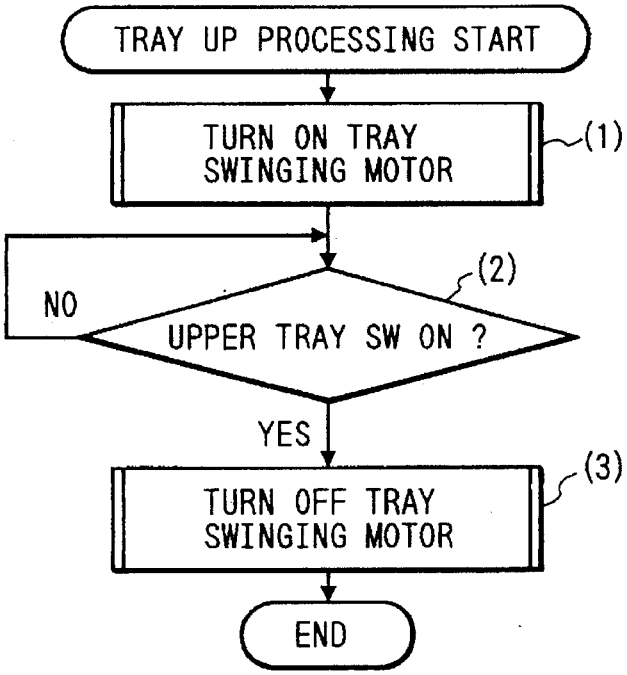
FIG. 18 is a flowchart showing a tray up processing procedure in the sheet transporting device.

On the other hand, if in the decision at step (7), the last original is judged, a continuous paper ejection processing (8) is executed. Thereafter, a tray up processing (9) (following a flowchart as shown in FIG. 18 and will be described later) is executed to move the original tray back to the upper limit position, and a series of processings is ended.

Note that the optical system of the main body, not shown, in the above processing is located at a position "D" as shown in FIG. 4, that is, L1 (mm) or greater downstream from the relay roller 17 in a clockwise direction where the length of the original in the feeding direction is L1 (mm). Also, the position control of the optical system of the main body may be made by the well known stepping motor, or otherwise through the use of a mechanical stopper.

Figure 17:
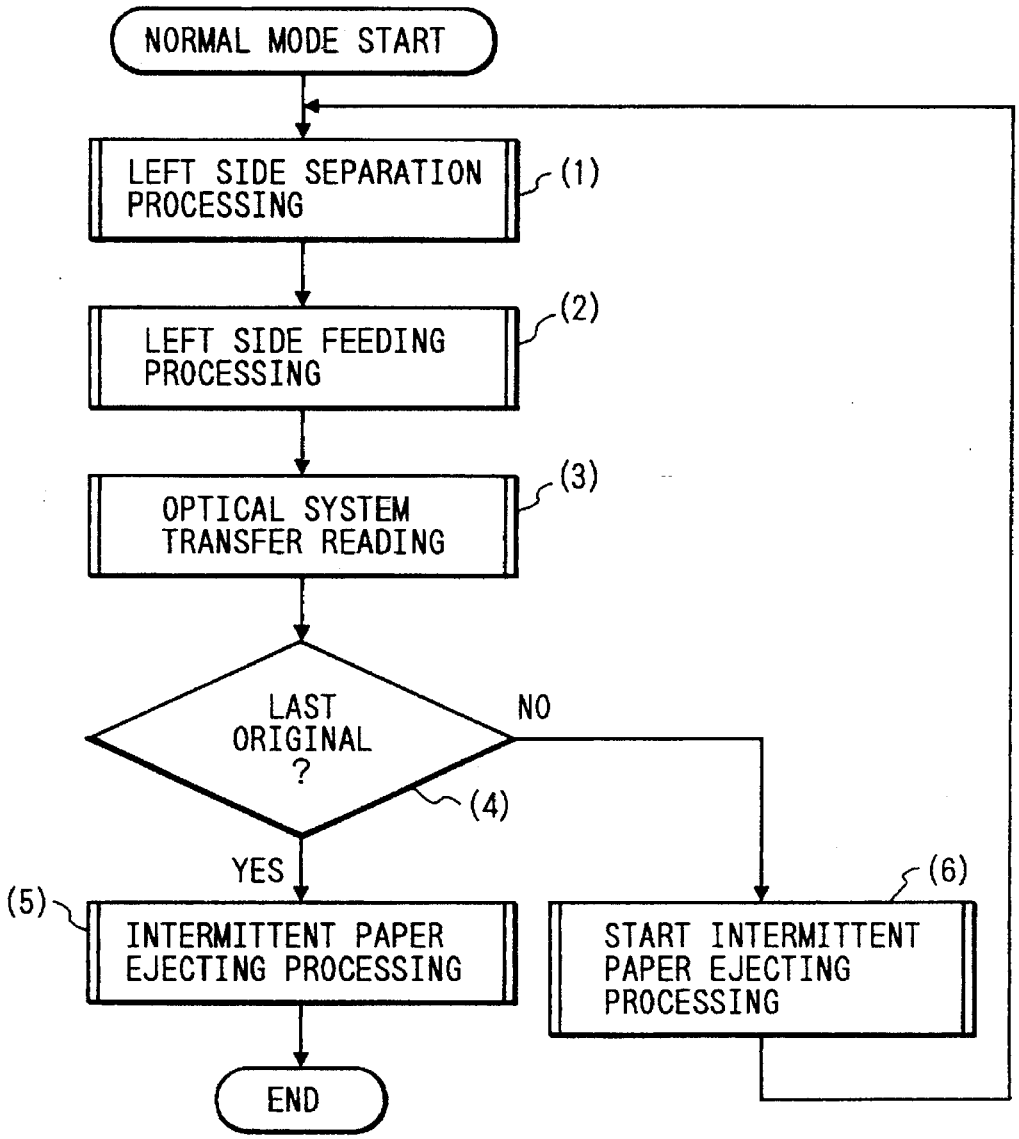
FIG. 17 is a flowchart showing an example of a normal switch back mode processing procedure in the sheet transporting device.

FIG. 17 is a flowchart showing one example of a normal switch back mode processing procedure in the sheet transporting device according to the present invention. Note that (1) to (6) indicate each step.

Figure 25:
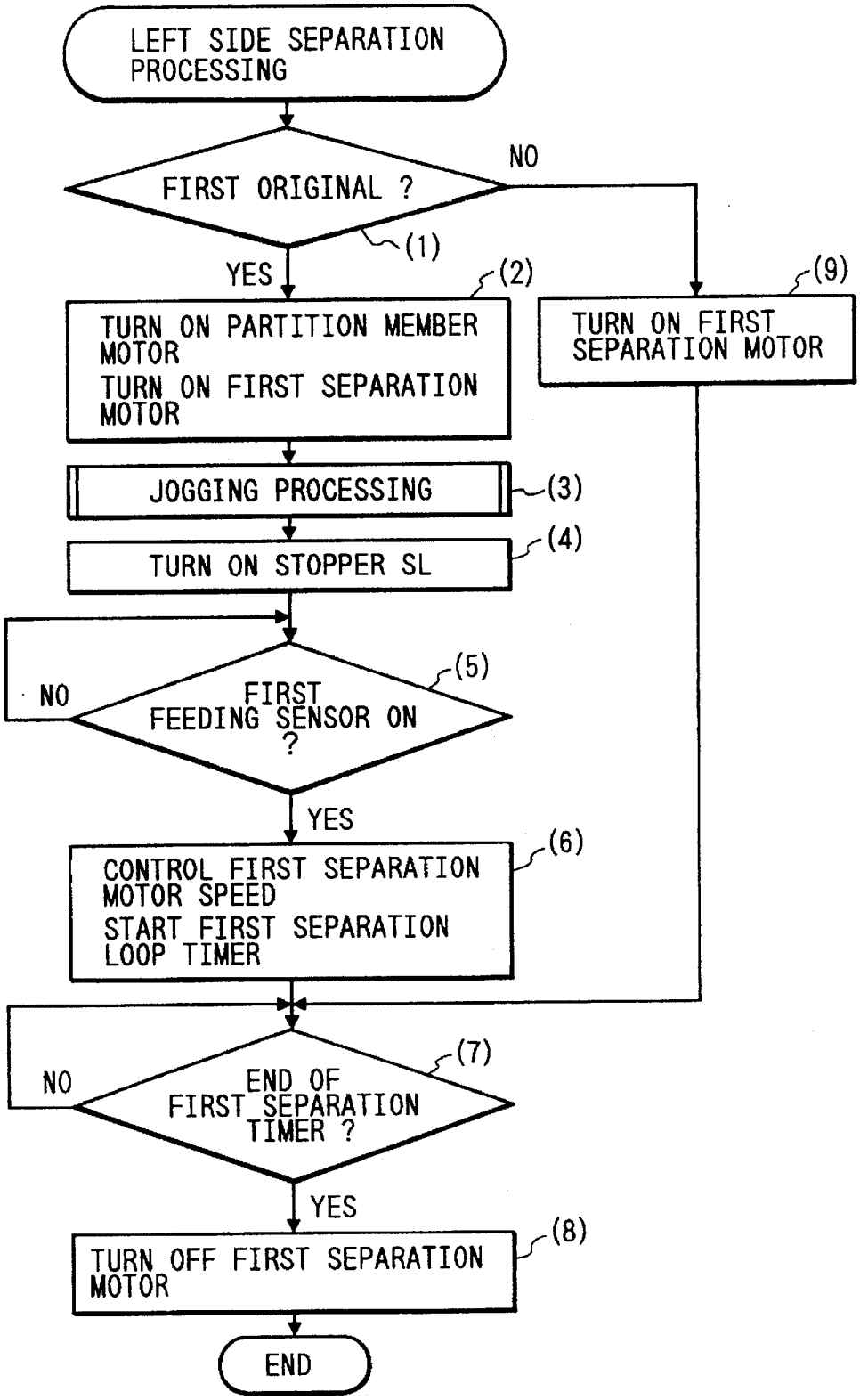
FIG. 25 is a flowchart showing an example of a left side separation processing procedure in the sheet transporting device.
Figure 26:
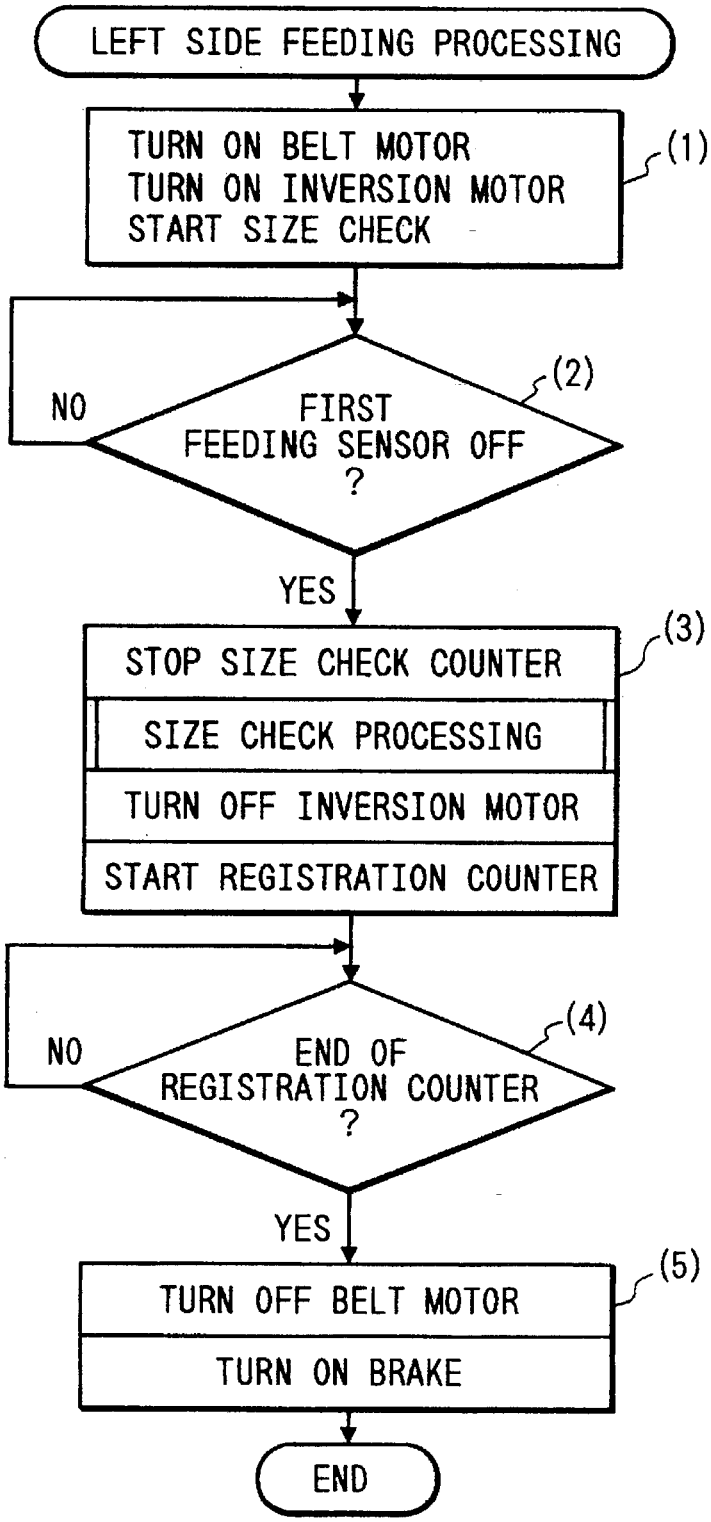
FIG. 26 is a flowchart showing an example of a left side feeding processing procedure in the sheet transporting device.
Figure 27:
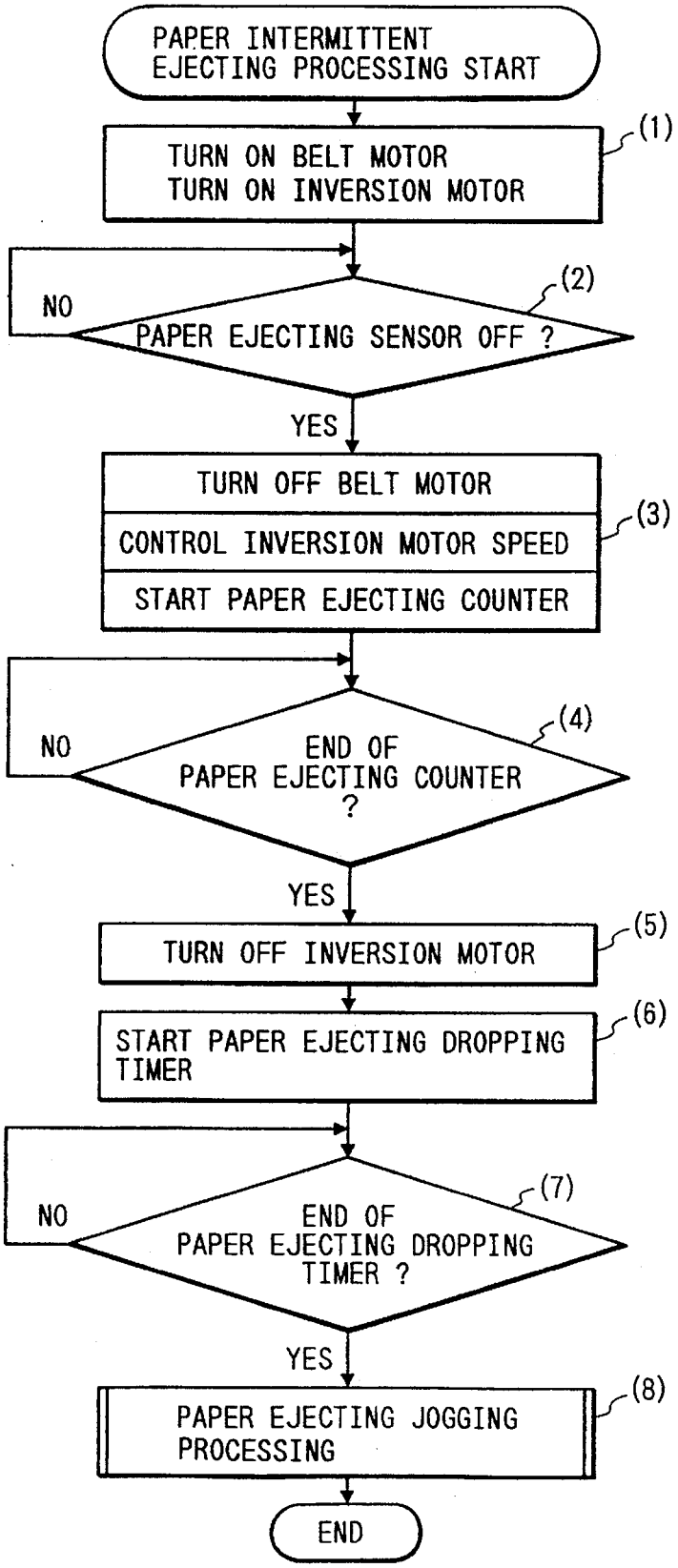
FIG. 27 is a flowchart showing an example of an intermittent paper ejection processing procedure in the sheet transporting device.

First, a left side separation processing (1) (following a flowchart as shown in FIG. 25 and will be described later) is executed to separate one original sheet on the bottom for the original bundle P on the original tray, and if that processing is completed, a left side feeding processing (2) (following a flowchart as shown in FIG. 26 and will be described later) is executed to stop the original on the platen glass 3. Thereafter, an optical system moving original reading processing (3) in which the original is read by scanning the original while moving the optical system of the main body, not shown, is executed. Then, the breakpoint of the original bundle P is detected by the original partition sensor 121 (4), and if not the last original, an intermittent paper ejecting processing (6) (following a flowchart as shown in FIG. 27 and will be described later) is started to return the original to the original tray, and the procedure returns to step (1) and repeats the processing.

On the other hand, if in the decision at step (4), the last original is judged, an intermittent paper ejecting processing (5) is executed, and a series of normal switch back mode is ended.

FIG. 18 is a flowchart showing one example of a tray up processing procedure in the sheet transporting device according to the present invention. Note that (1) to (3) indicate each step.

The tray up processing in this embodiment is such that, if detecting that the original is last and that the original detecting sensor 28 recognizes no original, after releasing that the partition member 22 partitions the originals on the original tray 4 at the last of the original copy, a tray swinging motor 107 is driven to elevate the original tray to the position of FIG. 1 until the upper limit switch 51 is turned on (1), and the driving of the tray swinging motor 107 (3) is stopped if the upper limit switch 51 is turned on (2), after which the processing is ended.

FIG. 19 is a flowchart showing one example of a tray down processing procedure in the sheet transporting device according to the present invention. Note that (1) to (3) indicate each step.

The tray down processing in this embodiment includes turning on the tray swinging motor (motor 107) (1), driving the tray swinging motor 107 (2) until the lower limit switch 52 is turned on to lower the original tray 4 to the position as shown in FIG. 2, and stopping the driving of the tray swinging motor 107 (3) if the lower limit switch 52 is turned on, after which the processing is ended.

FIG. 20 is a flowchart showing one example of a bundle transporting processing procedure in the sheet transporting device according to the present invention. Note that (1) to (4) indicate each step.

The bundle transporting processing in this embodiment includes turning on a sheet original stopper solenoid 111 (1) to transport the original bundle P on the original tray from the first paper feeding opening to the second paper feeding opening. Then, if detecting the bundle transporting home position sensor 45 to be turned on or off (2), (3), the original bundle transportation is performed by the stopper unit. And the sheet original stopper solenoid 111 and the stopper slide motor 106 are turned off, and the processing is ended.

Figure 21:
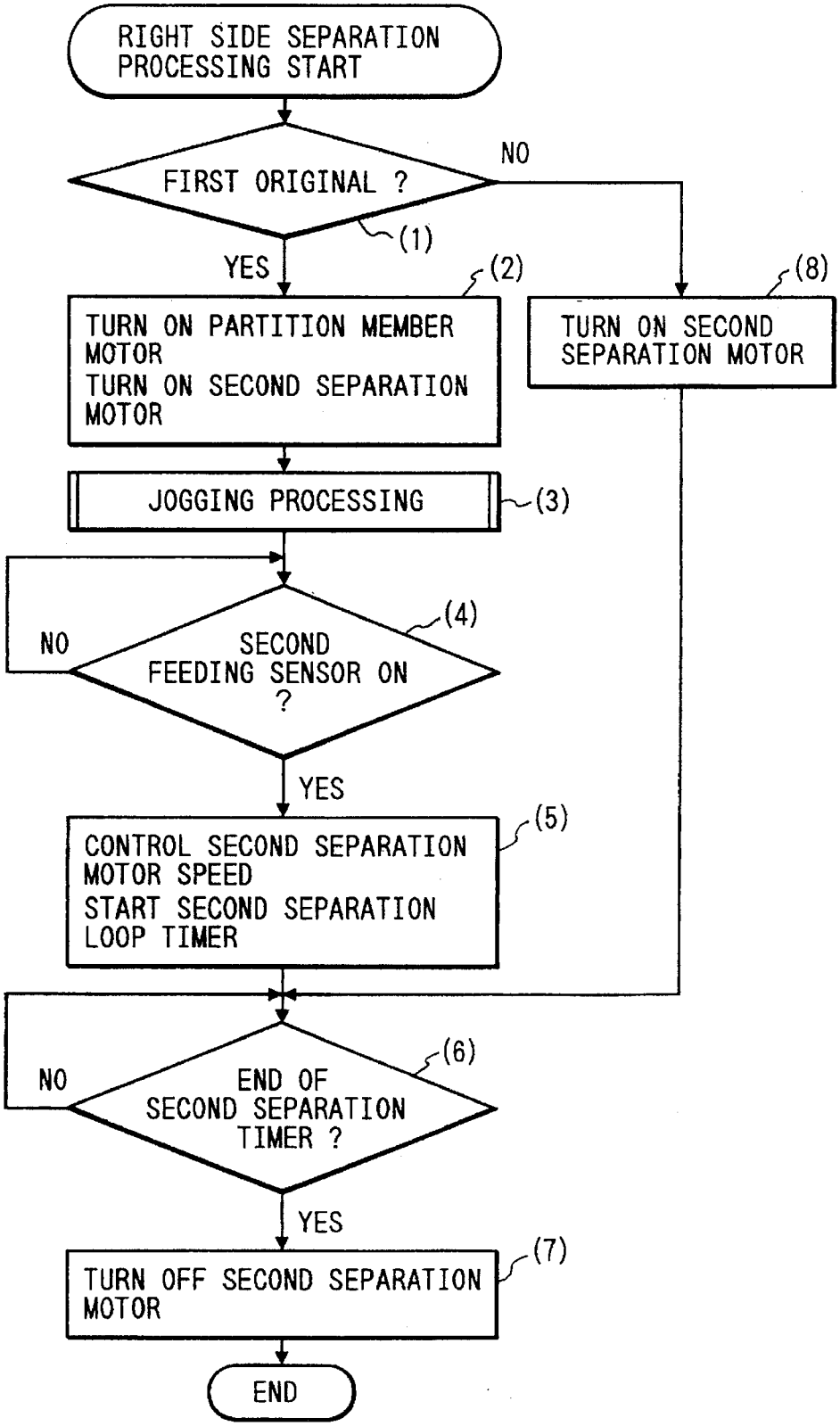
FIG. 21 is a flowchart showing an example of a right side separation processing procedure in the sheet transporting device.

FIG. 21 is a flowchart showing one example of a right side separation procedure in the sheet transporting device according to the present invention. Note that (1) to (8) indicate each step.

Figure 30:
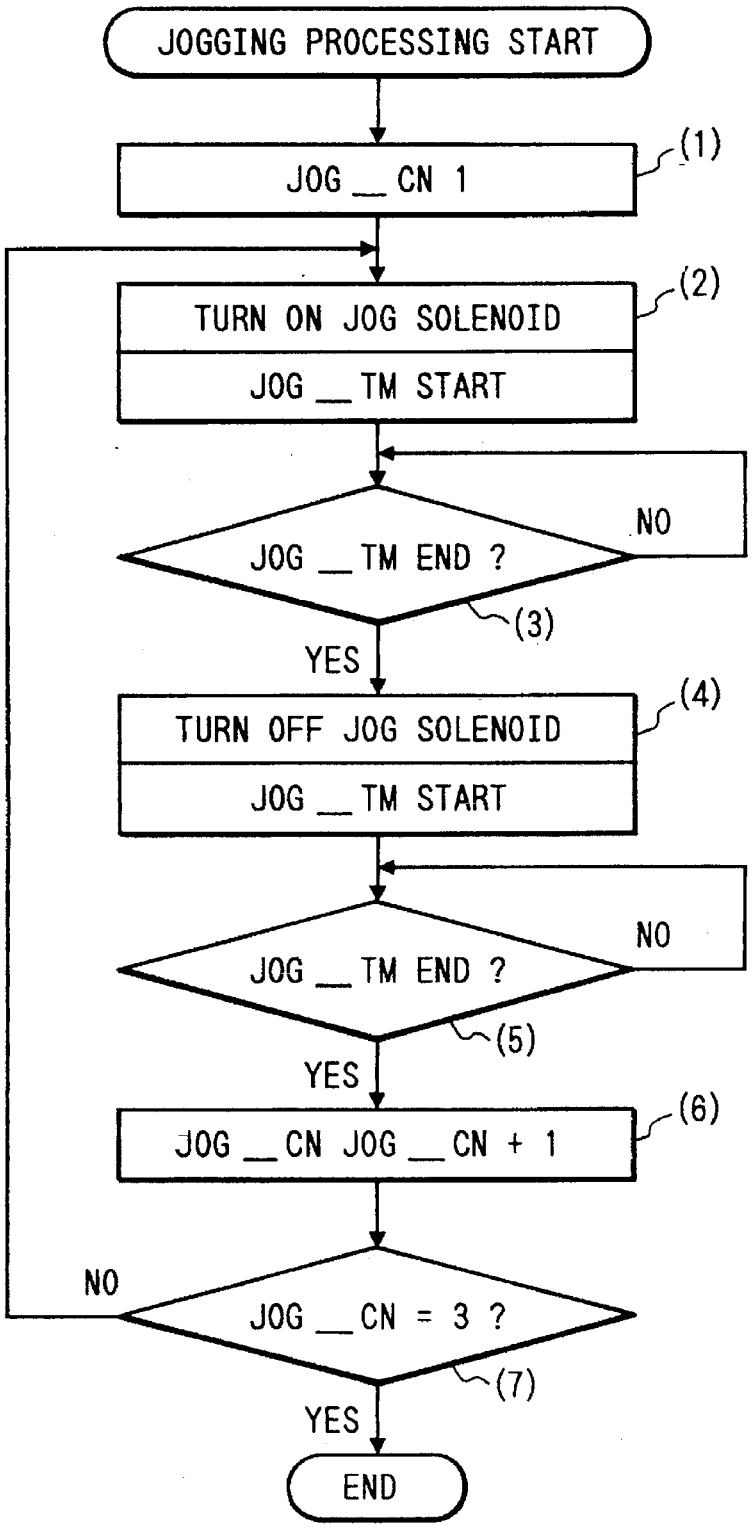
FIG. 30 is a flowchart showing an example of a jogging processing procedure.

First, a check is made to determine whether or not the original is the first sheet (1). If yes, the partition member motor 105 is turned on to operate a partition member to detect the breakpoint of the original bundle P, while at the same time the second separation motor 103 is turned on to separate out the original bundle P (2). Further, a jogging processing (3) (following a procedure as shown in FIG. 30 and will be described later) is executed to align the original bundle P in the bundle direction. After that, if the jogging processing is ended, the search is made through a sheet path so that the original on the bottom of the original bundle is separated by only one sheet, and if a second paper feeding sensor 30 detects the leading end of the original (4), a separation loop timer is started (5) while the speed control to drive the second separation motor 103 at low speeds is started. After this set time is terminated (6), the second separation motor 103 is turned off (7), so that the original has its top end abutting onto the nip portion of a pair of feeding rollers at low speed, thereby preventing damage to the top end of the original, with less collision sound, and further the original is stopped with a predetermined amount of loop formed. Thereby, when the skewed running occurs in separation, this skewness can be corrected.

On the other hand, if the decision at step (1) is no, that is, for the second original and downwards, the second separation motor 103 is turned on (8), and the procedure proceeds to step (6), where waiting for the separation loop timer to be terminated, the separation motor 103 is turned off.

Figure 22:
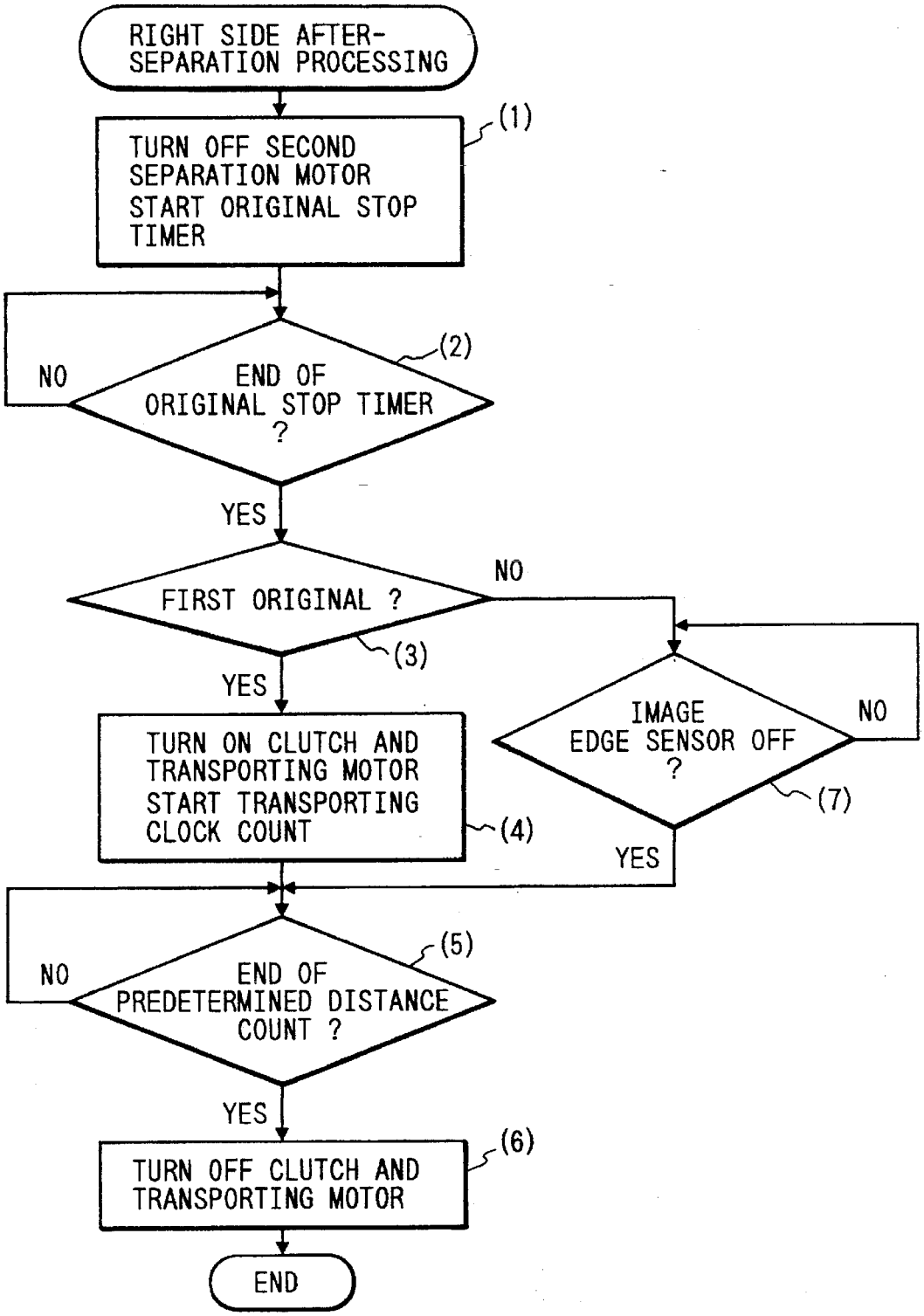
FIG. 22 is a flowchart showing an example of a right side after-separation processing procedure in the sheet transporting device.

FIG. 22 is a flowchart showing one example of a right side after-separation processing procedure in the sheet transporting device according to the present invention. Note that (1) to (6) indicate each step.

With the right side separation processing, the second separation motor 103 is turned off, and at the same time the original stop timer is started (1). If the set time has terminated (the original stop timer has terminated) (2), a check is made to determine whether or not the original is the first sheet (3). If no, the clutch 113 is connected, and the transporting motor 104 is turned on. For the second original and downwards, after detecting (7) that the trailing end of the previous original has passed through the image edge sensor 18 after the set time of the original stop timer has terminated, the clutch 113 is connected, and the counting of a clock sensor **104*b* of the transporting motor 104 is started (4) at the same time when the transporting motor 104 is turned on. When this count value reaches a count value corresponding to a predetermined distance not exceeding the distance between the relay roller 17 and the image edge sensor 18 (5), the operation of the transporting motor 104 is stopped, and the clutch 113 is disconnected (6). And the processing is ended. Note that if the speed of the transporting motor 104 to perform the above processing is controlled to be higher than the speed of reading the original, that is, the speed of the belt motor 102, the interval between the previous original and the current original which has been apart in separating the original can be put closer. Also, the speed of the transporting motor 104** may be synchronized with the speed of the transporting unit ahead and behind, if the original is on the transporting unit ahead and behind, whereas if the original is not on, the speed may be increased.

FIG. 23 is a flowchart showing one example of an original flow reading processing procedure in the sheet transporting device according to the present invention. Note that (1) to (3) indicate each step.

In the original flow reading processing of this embodiment, the transporting motor 104 is turned on in synchronism with (at the same speed as) the speed of the belt motor 102 for flow reading to read the original image with the optical system of the main body which is fixed, while at the same time the control for the constant speed of the belt motor 102 is started by outputting a reference signal based on the flow reading speed data v received from the main body to the PLL circuit 2203 (1). After that, at the same time when the top end of the original is detected by the image edge sensor 18 (2), the image edge signal is sent to the main body (3), after which the processing is ended.

Note that after the main body has received the image edge signal, the image reading is actually performed by calculating and controlling the time until the top end of the original reaches the optical system fixed position in flow reading, as previously described. Also, the flow reading speed data v may or may not be equal to the reading speed v1 in moving the optical system. In particular, since if v>v1 is set, the reading of the original image is completed in a shorter time than the normal reading by moving the optical system, so that the image forming speed is increased by using the sheet transporting device as shown in this embodiment.

FIG. 24 is a flowchart showing one example of a continuous paper ejecting processing procedure in the sheet transporting device according to the present invention. Note that (1) to (10) indiate each step.

First, the inversion motor 101 is turned on in synchronism (at the same speed as) with the speed of the belt motor 102 for flow reading to eject the original on the platen glass (1). Then, if the trailing end of the original is detected by the inversion sensor 26 (2), the inversion motor 101 is speeded up to the maximum speed (3) to secure the paper-to-paper interval to the next original. If the trailing end of the original transported from the sheet path (IV) to the sheet path (VI) is detected by the paper ejecting sensor 27 (4), a paper ejection counter to determine the distance for ejecting the original onto the original tray is started (5) while controlling the speed of the inversion motor 101 for the consistency of the paper ejection. If the paper ejection counter is terminated (6), the inversion motor 101 is turned off (7), and a paper ejection dropping timer to take the interval until the original drops onto the original tray 4 is started (8). If the timer is terminated (9), a closed loop paper ejection jogging processing (10) is executed to align ejected originals therewith, and the continuous feeding intermittent paper ejection processing is terminated.

FIG. 26 is a flowchart showing one example of a left side separation processing procedure in the sheet transporting device according to the present invention. Note that (1) to (8) indicate each step.

First, a check is made to determine whether or not the original is the first sheet (1). If no, the first separation motor is turned on (9), and the procedure returns to step (7). If yes, the first separation motor 100 is turned on to separate out the original bundle P while at the same time the partition member motor 105 is turned on to activate a partition member to detect the breakpoint of the original bundle P (3). Further, a jogging processing (3) as hereinafter described is executed to align the original bundle P in the width direction. Thereafter, if the jogging processing is terminated, a stopper solenoid 111 is turned on to lower the paper feeding stopper to separate only one original on the bottom of the original bundle P (4), and if the first paper feeding sensor 25 detects the top end of the original by proceeding through the sheet path (I) (5), the speed control to drive the first separation motor 100 at low speed is started, and the separation loop timer is started (6). After termination of this set time (7), the first separation motor 100 is turned off (8), and the processing is ended.

Thereby, since the original has its top end abutting onto the nip portion of a pair of paper feeding rollers at low speed, the damaging of the top end of the original can be prevented and the collision sound can be relieved. Further, the original is stopped with a predetermined amount of loop formed, whereby even if skewed running occurs in separation, this skewness can be corrected.

FIG. 26 is a flowchart showing one example of a left side paper feeding processing procedure in the sheet transporting device according to the present invention. Note that (1) to (5) indicate each step.

Figure 29:
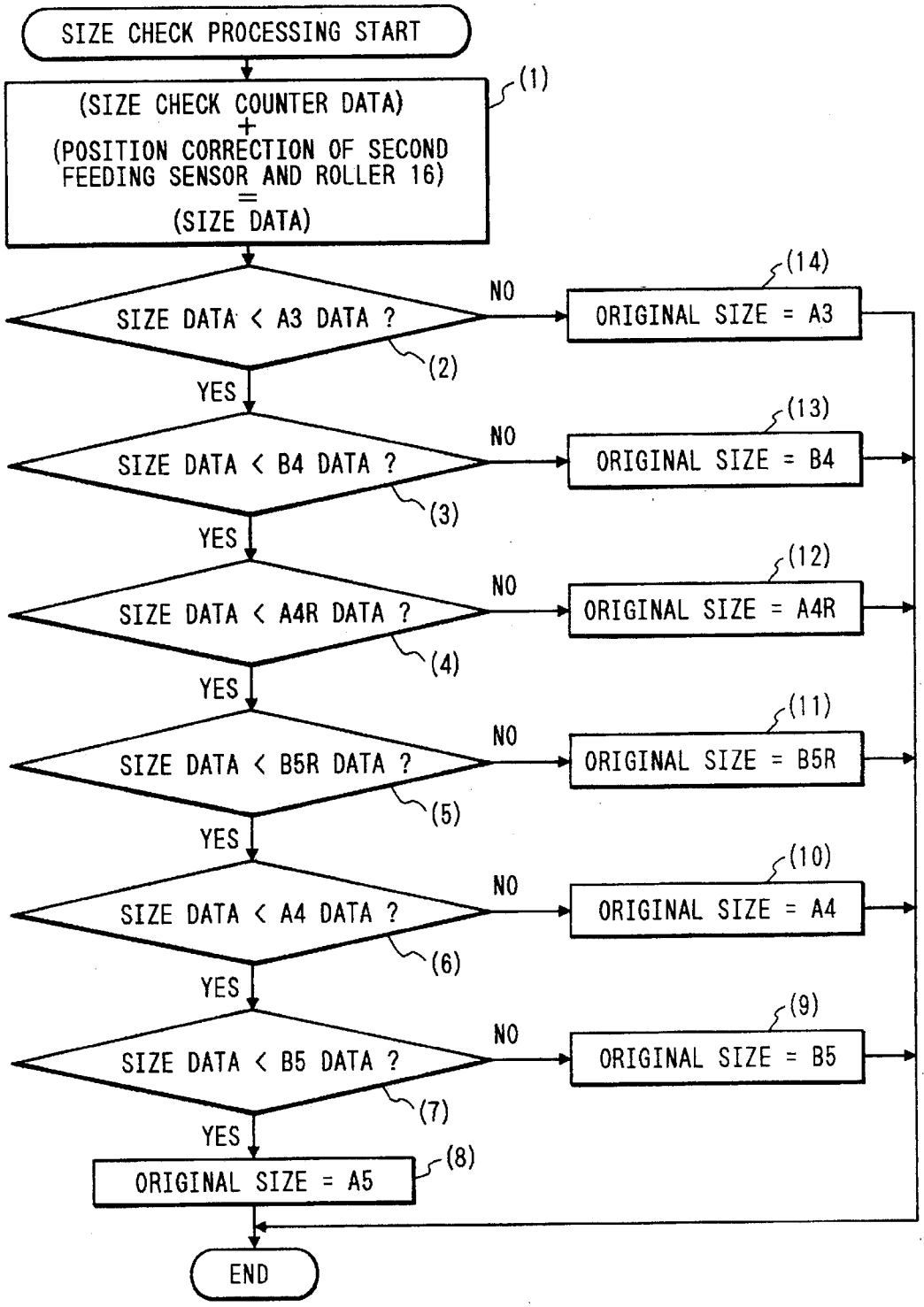
FIG. 29 is a flowchart showing an example of a second size check processing procedure in the sheet transporting device.

To transport the original from the sheet path (I) to the sheet path (III) by driving a pair of paper feeding rollers, and an overall surface feeding belt, the belt motor 102 is turned on in normal rotation and the inversion motor is turned on, and at the same time the size check counter for counting with the clock signal input from the inversion clock sensor **101*b* is started (1). And at the same time when the original is transported with its trailing end having passed by the first paper feeding sensor 25 (2), the size check counter is stopped. Based on that data, the original size is judged in a size check processing following a procedure as shown in FIG. 29 and will be described later, and a resist counter which is counted by a clock disk 102*a*, and a clock sensor 102*b* is started (3) to stop the original at a predetermined position on the platen (original trailing end position (see the position D in FIG. 4)). At the time when the registration counter which has been started is ended (4), the belt motor is turned off, and the original is stopped at high precision by turning on the brake (5**), after which the processing is ended.

FIG. 27 is a flowchart showing one example of an intermittent paper ejection processing procedure in the sheet transporting device according to the present invention. Note that (1) to (8) indicate each step.

First, to eject the original sheet on the platen glass, the belt motor 102 is turned on in reverse rotation, and the inversion motor is turned on (1). Then, if the trailing end of the original transported from the original sheet path (IV) to the sheet path (VI) is detected by the paper ejection sensor 27 (2), the belt motor is turned off, and a paper ejection counter to determine the distance to eject the original on the original tray is started (3) while the speed control of the inversion motor 101 is being performed for the control of paper ejection. If the paper ejection counter is terminated (4), the inversion motor 101 is turned off (5), and a paper ejection dropping timer to take the interval until the original drops onto the original tray is driven (6), and after the timer is terminated (7), the paper jogging processing to align ejected original therewith is made (8), and the intermittent paper ejection processing is ended.

Figure 28:
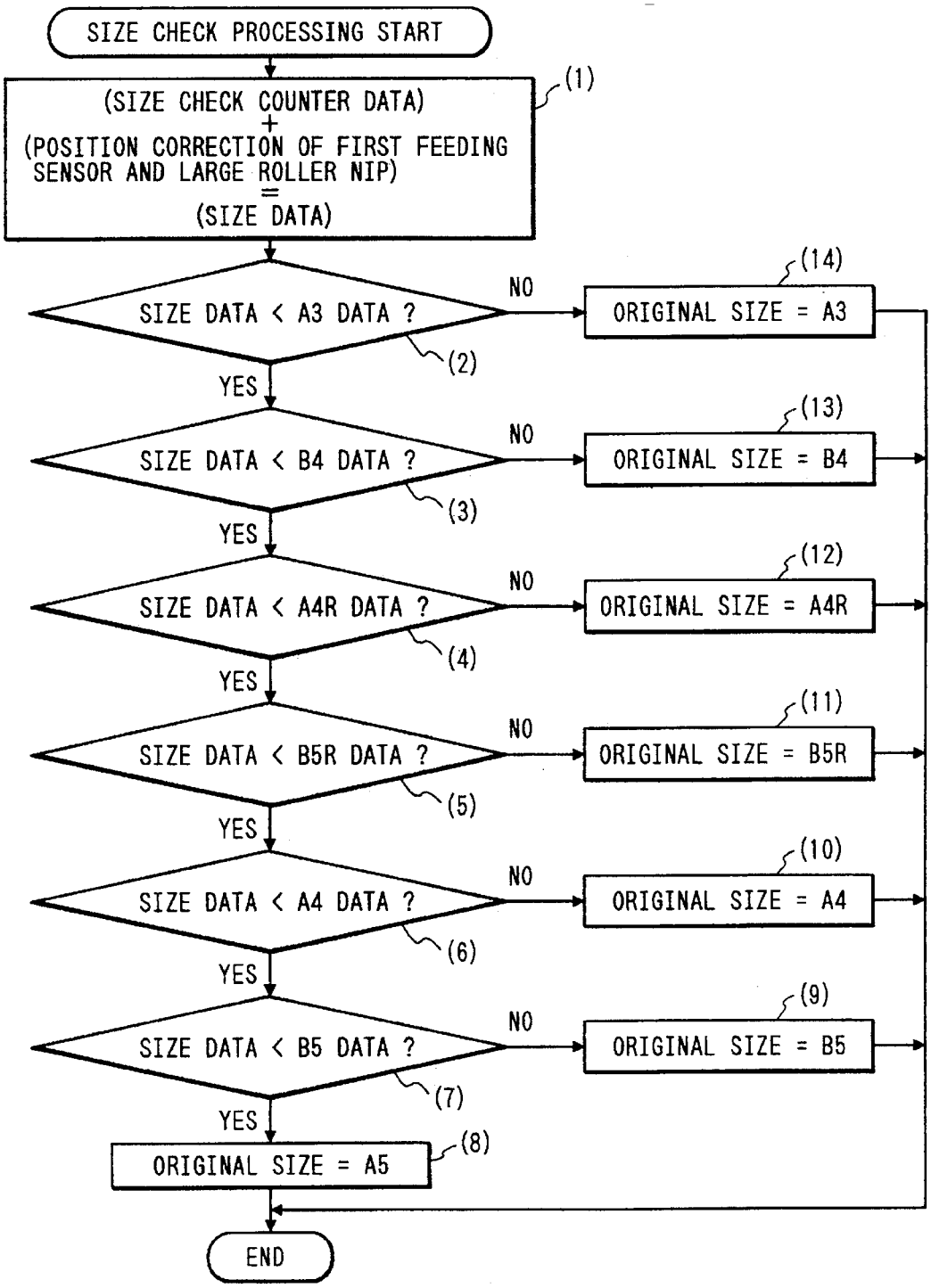
FIG. 28 is a flowchart showing an example of a first size check processing procedure in the sheet transporting device.

FIG. 28 is a flowchart showing one example of a first size check processing procedure in the sheet transporting device according to the present invention. Note that (1) to (14) indicate each step.

First, the distance from the nip position of the large roller 10 to the first paper feeding sensor 25 is added to the size check counter data and corrected to obtain a true original size data (1). At this time, the original is transported by the paper feeding roller and the overall face belt, in which its feeding amount and the count value by the belt clock are exactly identical. Thereafter, the size data obtained at step (1) is compared to each data of A3, B4, A4R, B5R, A4, and B5 (2) to (7), and the size is determined to be any of A5, B5, A4, B5R, A4R, B4 and A3 (8) to (14).

FIG. 29 is a flowchart showing one example of a second size check processing procedure in the sheet transporting device according to the present invention. Note that (1) to (14) indicate each step.

First, the distance from the nip position of the roller 16 to the second paper feeding sensor 30 is added to the size check counter data and corrected to obtain a true original size data (1). At this time, the original is transported by the paper feeding roller and the overall face belt, in which its feeding amount and the count value by the belt clock are exactly identical. Thereafter, the size data obtained at step (1) is compared to each data of A3, B4, A4R, B5R, A4, and B5 (2) to (7), and the size is determined to be any of A5, B5, A4, B5R, A4R, B4 and A3 (8) to (14).

FIG. 30 is a flowchart showing one example of a jogging processing procedure according to the present invention. Note that (1) to (7) indicate each step.

First, a counter JOG-CN for determining the number of joggings is initialized (1). Then, a jogging solenoid 132 to forward the jogging guide of the width regulating member out is turned on, and at the same time a timer JOG-TM which can be arbitrarily set is started (2). If the timer JOG-TM has ended the set time (3), the jogging solenoid 132 is turned off to move the jogging guide back to the initial state, and the timer *JOGTM is started (4) as above described. If the set time of the timer JOGTM has terminated (5), the counter JOG-CN for counting the number of joggings is incremented by 1 (6), and a check is made to determine whether or not the value of the counter JOG-CN is 3, that is, the reciprocating operation of the jogging guide is terminated three times (7). If no, the procedure returns to step (2) to repeat the above processing. If yes, the processing is ended.

Thereby, the original bundle P is aligned in the width direction to prevent the skewed running or offset registration.

Figure 31:
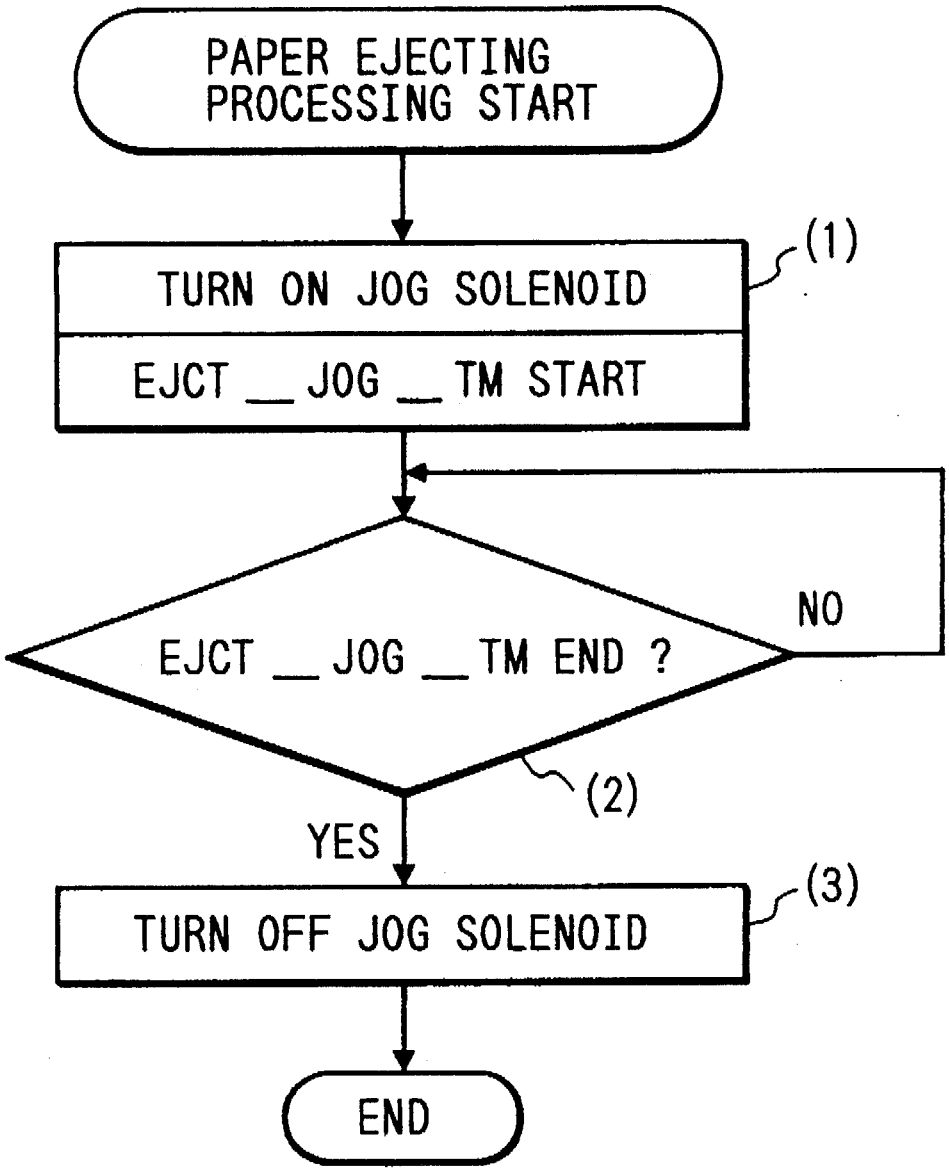
FIG. 31 is a flowchart showing an example of a paper ejection jogging processing procedure in the sheet transporting device.

FIG. 31 is a flowchart showing one example of a paper ejection jogging processing procedure in the sheet transporting device according to the present invention. Note that (1) to (3) indicate each step.

The jogging solenoid 132 to forward the jogging guide of the width regulating member out is turned on, and at the same time a timer EJCT JOG-TM which can be arbitrarily set is started (1). If the timer EJCT JOG-TM has ended the set time (2), the jogging solenoid 132 is turned off to move the jogging guide back to the initial state (3), whereby the original bundle P is aligned in the width direction to prevent the skewed running or offset registration.

Figure 32:
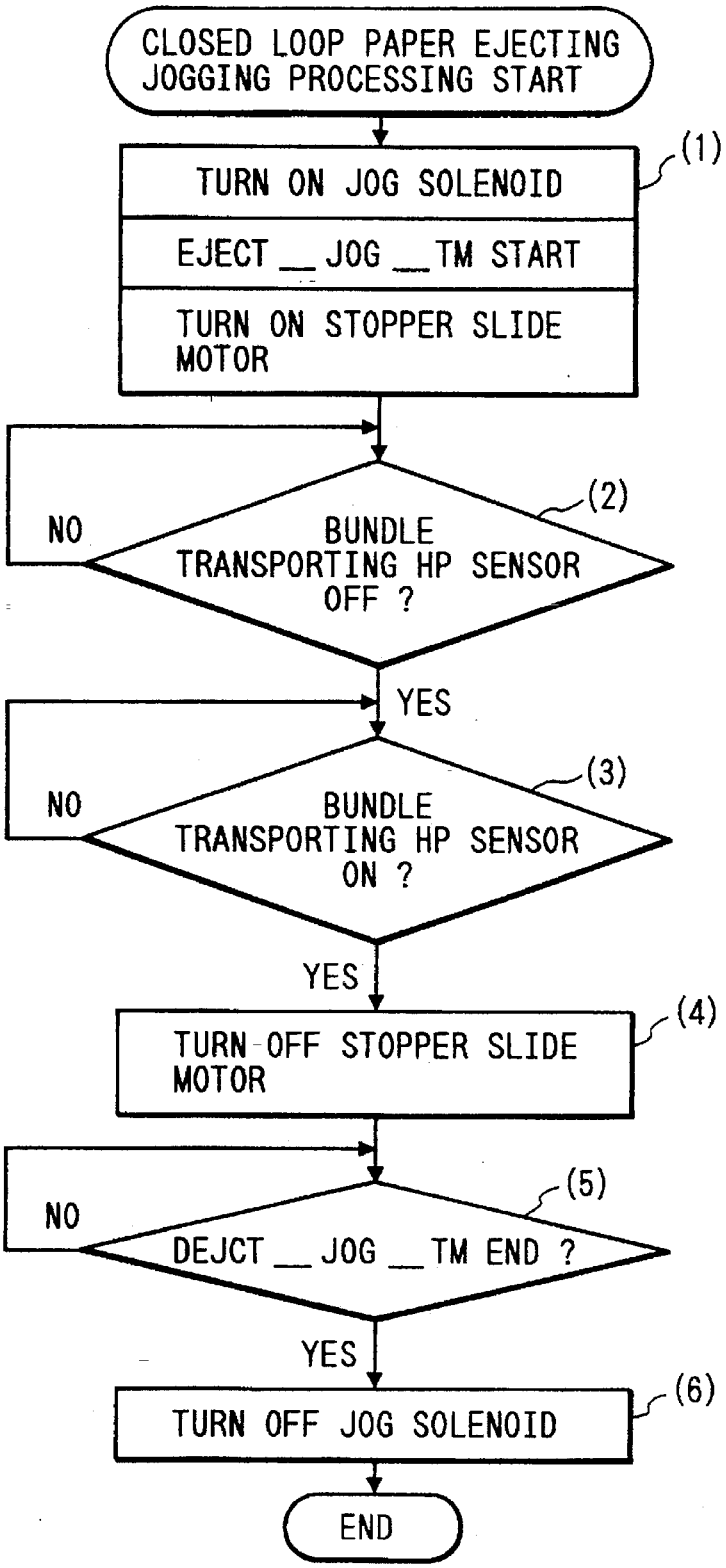
FIG. 32 is a flowchart showing an example of a closed loop paper ejection jogging processing procedure in the sheet transporting device.
Figure 33:
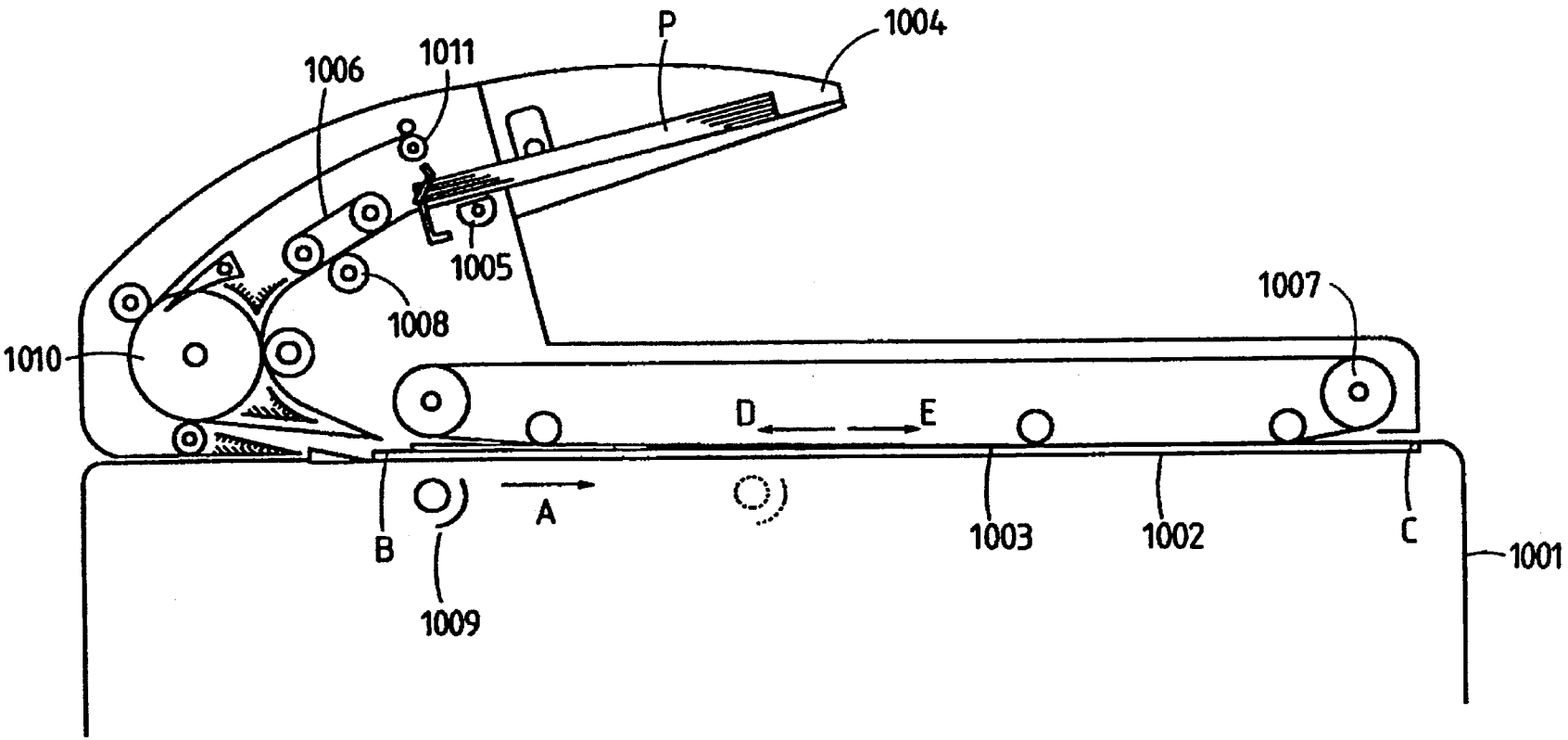
FIG. 33 is a cross-sectional view showing an example of a conventional sheet transporting device.

FIG. 32 is a flowchart showing one example of a closed loop paper ejection jogging processing procedure in the sheet transporting device according to the present invention. Note that (1) to (6) indicate each step.

The jogging solenoid 132 to forward the jogging guide of the width regulating member out is turned on, and a stopper slide motor 106 is turned on to enhance the alignment in the feeding direction, while at the same time, the timer which can be arbitrarily set is started (1). The bundle transporting home position sensor 45 is monitored while waiting for the timer DEJCT JOG TM to be ended, and if it is returned to the home position, the stopper slide motor 106 is turned off (2) to (4). If the set time for the timer DEJCT JOG TM is terminated (5), the jogging solenoid 132 is turned off (6) to move the jogging guide back to the initial state, after which the processing is ended.

Thereby, the original bundle P is aligned in the width direction to prevent the skewed running or offset registration. Also, the timer DEJCT JOG TM is set to the time sufficient for the stopper unit to be rotated once.

While in the right side after-separation processing of the above embodiment, the clutch 113 is disconnected after termination of the transporting operation for a predetermined distance, it will be appreciated that when the trailing end of the original during the transporting of the original is detected by the after-separation sensor 29 as shown in FIG. 1, the clutch 113 may be controlled to be disconnected. Thereby, the separation operation of the original next to the original during the processing of the right side separation can be started, resulting in higher productivity.

While the above embodiment has been described with a sheet transporting mechanism in the sheet path (VIII), (IX) with the driving force transmitted to each paper feeding roller by the clutch 113 and the one-way clutch (not shown), it will be appreciated that the sheet transporting mechanism can be simplified by the synchronization between the second separation motor 103 and the transporting motor 104.

For example, utilizing the clock sensor 104*b* of the transporting motor, the PLL control of the separation motor is made or can be realized by making the separation motor a stepping motor.

Also, the use of a stepping motor as the transporting motor can be made to give exciting pulses in synchronism with the separation motor to the same effects.

Further, when the driving source is replaced with the stepping motor, the holding torque is greater than that of the DC motor, the rotation of the relay roller upon impact of the original abutted against the relay roller by the separation motor can be prevented.

Thus, in the above embodiment, since the original which has undergone the separation operation by the second separation motor is transported at high speed by the transporting motor 104 before original reading processing, the original interval between the current original and the previously transported original can be shortened, so that it is possible to recuperate the delay of the time taken to separate the original from the original loading tray, due to the difference in the kind of original or the loading amount of the original, or the difference in the environmental conditions. Accordingly, in the original flow reading mode, when reading the original image, the time interval for feeding the original successively is sufficient to the time interval for which the copying paper of the main body is fed successively, so that the image processing can be made without decreasing the maximum processing speed set in the image processing device for the sheet processing, with significantly higher productivity.

What is claimed is:

1. An original transporting device for transporting a plurality of originals to an exposure unit of a copying machine comprising:

loading means for loading the plurality of originals;

first separation means for separating a first original on the bottom of the plurality of originals loaded on said loading means from a first side of said loading means;

first transporting means for transporting the first original separated by said first separation means along a first transporting passageway;

second separation means for separating a second original on the bottom of the plurality of originals loaded on said loading means from a second side of said loading means;

second transporting means for transporting the second original separated by said second separation means along a second transporting passageway;

third transporting means for transporting the first original transported by said first transporting means in a first direction, stopping the first original at said exposure unit for a while, then transporting the first original in a second direction, and transporting the second original transported by said second transporting means in the second direction to pass through said exposure unit; and ejection means for ejecting the first and second originals transported by said third transporting means from said exposure unit in the second direction onto said loading means;

wherein the transporting speed of said second transporting means is higher than the transporting speed of said third transporting means in the second direction.

2. An original transporting device according to claim 1, wherein said third transporting means stops the first original transported by said first transporting means at said exposure unit before starting the exposure, then transports the first original from said exposure unit after terminating the exposure, and causing the second original transported by said second transporting means to pass through said exposure unit during the exposure.

3. An original transporting device according to claim 1, wherein said first and second separation means and said first and second transporting means can be operated continuously.

4. An original transporting device according to claim 1, wherein said third transporting means comprises a transporting belt.

5. An original transporting device for transporting an original to an exposure unit of an exposure device, comprising:

loading means for loading the original;

separation means for separating the original loaded on said loading means;

first transporting means for transporting the original separated by said separation means along a transporting passageway; and second transporting means for transporting the original transported by said first transporting means to pass through said exposure unit to expose the original being passed, wherein the transporting speed of said first transporting means is higher than the transporting speed of said second transporting means.

6. An original transporting device according to claim 5, wherein said separation means and said first and second transporting means can be operated continuously.

7. An original transporting device according to claim 6, wherein said second transporting means comprises a transporting belt.

8. An original transporting method for transporting an original to an exposure unit of an exposure device, comprising the steps of:

separating the original loaded on loading means;

making a first transportation of the separated original along a transporting passageway; and making a second transportation of the original which has undergone said first transportation to pass through said exposure unit to expose the original being passed, wherein the transporting speed of said first transportation is higher than the transporting speed of said second transportation.

9. An original transporting method according to claim 8, wherein the original loaded on said loading means is continuously transported.

10. An original transporting method for transporting a plurality of originals to an exposure unit of a copying machine comprising the steps of:

loading a plurality of originals on a loader;

separating by a first separator a first original on the bottom of the plurality of originals loaded on the loader from a first side of the loader;

transporting by a first transporter the first separated original along a first transporting passageway;

separating by a second separator a second original on the bottom of the plurality of originals loaded on the loader from a second side of the loader;

transporting by a second transporter the second separated original along a second transporting passageway;

transporting by a third transporter the first original in a first direction, stopping the first original at the exposure unit for a while, then transporting the first original in a second direction, and transporting by the third transporter the second original in the second direction to pass through the exposure unit; and ejecting the first and second originals transported by the third transporter from the exposure unit in the second direction onto the loader, wherein the transporting speed of the second transporter is higher than the transporting speed of the third transporter in the second direction.

11. An original transporting method according to claim 10, wherein the third transporter stops the first original transported by the first transporter at the exposure unit before starting the exposure, then transports the first original from the exposure unit after terminating the exposure, and causes the second original transported by the second transporter to pass through the exposure unit during the exposure.

12. An original transporting method according to claim 10, wherein the first and second separators and the first and second transporters are operated continuously.

* * * * *

UNITED STATES PATENT AND TRADEMARK OFFICE

CERTIFICATE OF CORRECTION

PATENT NO. : 5,629,763

DATED : May 13, 1997

INVENTOR(S) : YOSHINORI ISOBE, ET AL.

It is certified that error appears in the above-identified patent and that said Letters Patent is hereby corrected as shown below:

COLUMN 1
Line 26, "corporation" should read --cooperation--;
Line 37, "on to" should read --onto--.

COLUMN 4
Line 15, "serve" should read --serves--;
Line 43, "connected" should read --connect--.

COLUMN 6
Line 33, "a" (2nd occurrence) should be deleted.

COLUMN 8
Line 44, "is a" should read --are-- and, "view" should read --views--.

COLUMN 9
Line 27, "troubles" should read --problems--;
Line 47, "leave" should read --spring--.

UNITED STATES PATENT AND TRADEMARK OFFICE

CERTIFICATE OF CORRECTION

PATENT NO. : 5,629,763

DATED : May 13, 1997

INVENTOR(S) : YOSHINORI ISOBE, ET AL.

It is certified that error appears in the above-identified patent and that said Letters Patent is hereby corrected as shown below:

COLUMN 11
Line 18, "turn" should read --turned--.

COLUMN 14
Line 38, "indiate" should read --indicate--.

Signed and Sealed this

Twenty-fifth Day of November, 1997

*Attest:*

Bruce Lehman

BRUCE LEHMAN

*Attesting Officer*

*Commissioner of Patents and Trademarks*